US008835732B2

(12) United States Patent
Miki et al.

(10) Patent No.: US 8,835,732 B2
(45) Date of Patent: Sep. 16, 2014

(54) TONE CONTROL DEVICE

(71) Applicant: Roland Corporation, Hamamatsu (JP)

(72) Inventors: Junichi Miki, Hamamatsu (JP); John K. McFerran, North Plains, OR (US); Takahiro Sugizaki, Hamamatsu (JP); Kenji Nogami, Hamamatsu (JP)

(73) Assignee: Roland Corporation, Hamamatsu (JP)

( * ) Notice: Subject to any disclaimer, the term of this patent is extended or adjusted under 35 U.S.C. 154(b) by 0 days.

(21) Appl. No.: 13/919,970

(22) Filed: Jun. 17, 2013

(65) Prior Publication Data

US 2014/0000439 A1 Jan. 2, 2014

(30) Foreign Application Priority Data

Jun. 29, 2012 (JP) ..... 2012-146942

(51) Int. Cl.
*G10B 3/10* (2006.01)
*G10G 7/02* (2006.01)
*G10B 3/00* (2006.01)

(52) U.S. Cl.
CPC ... *G10G 7/02* (2013.01); *G10B 3/00* (2013.01)
USPC ..... 84/337; 84/331; 84/456

(58) Field of Classification Search
CPC ..... G10G 7/02; G10G 3/06
See application file for complete search history.

(56) References Cited

U.S. PATENT DOCUMENTS

| | | | | | |
|---|---|---|---|---|---|
| 2,619,866 | A | * | 12/1952 | Bailey | 84/349 |
| 3,327,044 | A | * | 6/1967 | Markowitz | 84/692 |
| 3,718,747 | A | * | 2/1973 | Martin et al. | 84/600 |
| 4,157,049 | A | * | 6/1979 | Watanabe | 84/620 |
| 4,303,000 | A | * | 12/1981 | Peterson | 84/346 |
| 4,338,849 | A | * | 7/1982 | Turner | 84/345 |
| 4,341,145 | A | * | 7/1982 | Peterson | 84/337 |
| 4,350,073 | A | * | 9/1982 | Peterson | 84/672 |
| 4,393,741 | A | * | 7/1983 | Budelman | 84/620 |
| 5,442,128 | A | * | 8/1995 | Bodini et al. | 84/620 |
| 6,369,310 | B1 | * | 4/2002 | Brunson et al. | 84/600 |
| 7,626,104 | B2 | * | 12/2009 | Scriba et al. | 84/331 |
| 7,777,116 | B2 | * | 8/2010 | Luciani | 84/456 |
| 2014/0000439 | A1 | * | 1/2014 | Miki et al. | 84/456 |

FOREIGN PATENT DOCUMENTS

JP 2009511983 3/2009

* cited by examiner

*Primary Examiner* — Robert W Horn
(74) *Attorney, Agent, or Firm* — David W. Victor; Konrad Raynes Davda & Victor LLP

(57) ABSTRACT

Provided is a tone control device coupled to a musical instrument including a plurality of pipes capable of generating tones with differing pitches for keys, wherein the pipes are arranged in rows, comprising: a tone generation device that generates tone; a pipe designation device that designates a specified pipe among the pipes installed; and a control device that causes the tone generation device to generate a substituting tone corresponding to the specified pipe when a depressed key comprising one of the keys corresponds to the specified pipe designated by the pipe designation device, and the specified pipe is a pipe belonging to one of the rows of pipes designated as a tone generation subject for the depressed key.

21 Claims, 14 Drawing Sheets

| | | DK1 | DK2 | | DK6 | | DK30 | SETTING RANGE |
|---|---|---|---|---|---|---|---|---|
| | DRAWKNOB NUMBER | 1 | 2 | ... | 6 | ... | 30 | |
| DA1 | Stop Name | TROMPETTE 8 | MIXTURE IV | | BOMBARDE 16 | | PRINCIPAL 8 | |
| DA2 | Timbre Number | 12 | 44 | | 18 | | 82 | 1 to 128 |
| DA3 | Belonging Keyboard | PEDAL | PEDAL | | PEDAL | | GREAT | PEDAL, SWELL, GREAT |
| DA4 | Pipe Stop Switch | OFF | OFF | | ON | | OFF | ON, OFF |
| DA5 | Pipe Stop Number | 21 | 22 | | 26 | | 48 | 1 to 300 |
| DA6 | Extension Switch | OFF | OFF | ... | ON | ... | OFF | ON, OFF |
| DA7 | Extn PC | OFF | OFF | | 15 | | OFF | OFF, 1 to 128 |
| DA8 | Lo Extn Limit | OFF | OFF | | C1-#12 | | OFF | OFF, C1 to C61 |
| DA9 | Hi Extn Limit | OFF | OFF | | OFF | | OFF | OFF, C1 to C61 |
| | Fixing Note#1 | OFF | OFF | | OFF | | OFF | ON, OFF |
| | Fixing Note#2 | OFF | OFF | | OFF | | OFF | ON, OFF |
| | Fixing Note#3 | OFF | OFF | | OFF | | OFF | ON, OFF |
| DA10 | ⋮ | ⋮ | ⋮ | ... | ⋮ | ... | ⋮ | |
| | Fixing Note#59 | OFF | OFF | | OFF | | OFF | ON, OFF |
| | Fixing Note#60 | OFF | OFF | | OFF | | OFF | ON, OFF |
| | Fixing Note#61 | OFF | OFF | ... | OFF | ... | OFF | ON, OFF |
| DA11 | Extn Level | 127 | 127 | | 75 | | 127 | 0 to 127 |
| DA12 | Extn Tone | 0 | 0 | | 0 | | 0 | -50 to +50 |
| DA13 | Extn Tune | 0 | 0 | | 0 | | 0 | -50 to +50 |

FIG. 3

TONE CONTROL DEVICE

CROSS-REFERENCE TO RELATED FOREIGN APPLICATION

This application is a non-provisional application that claims priority benefits under Title 35, United States Code, Section 119(a)-(d) from Japanese Patent Application entitled "TONE CONTROL DEVICE" by Junichi MIKI, John K. MCFERRAN, Takahiro SUGIZAKI, and Kenji NOGAMI, having Japanese Patent Application Serial No. 2012-146942, filed on Jun. 29, 2012, which Japanese Patent Application is incorporated herein by reference in its entirety.

BACKGROUND OF THE INVENTION

1. Field of the Invention

The invention relates to a tone control device for a musical instrument to select to generate tones from pipes or a tone generation device.

2. Description of the Related Art

A pipe organ produces sound, by driving pressurized air through pipes corresponding to keys depressed, from the pipes. The pipe organ includes multiple rows of pipes (ranks) according to different timbres, each composed of a plurality of pipes with differing pitches that pronounce one kind of timbre. The user performs by selecting a row of pipes with a desired timbre as the subject of tone generation.

An electronic organ that can simulate performance of the pipe organ described above is described in U.S. Pat. No. 7,777,116, also published as Japanese Patent Application No. 2009-511983. U.S. Pat. No. 7,777,116 describes an electronic organ configured as a combination organ that is combined with pipes of a pipe organ, and is capable of generating tones through the pipes corresponding to keys depressed, based on the same principle as that of a pipe organ.

SUMMARY

A tone control device coupled to a musical instrument including a plurality of pipes capable of generating tones with differing pitches for keys, wherein the pipes are arranged in rows, comprising: a tone generation device that generates tone; a pipe designation device that designates a specified pipe among the pipes installed; and a control device that causes the tone generation device to generate a substituting tone corresponding to the specified pipe when a depressed key comprising one of the keys corresponds to the specified pipe designated by the pipe designation device, and the specified pipe is a pipe belonging to one of the rows of pipes designated as a tone generation subject for the depressed key.

A computer storage device including program code executed by a processor for generating a tone and in communication with a tone generation device, a pipe controller controlling a plurality of pipes for producing sound, a plurality of keyboards each having keys, and manipulators for selecting ranks of pipes to generate sound, wherein the code is executed to perform operations, the operations comprising: generating a data structure in the computer storage device indicating for each of the manipulators: a belonging keyboard indicating one of the keyboards; one of the ranks of pipes to play for the manipulator; a pipe stop switch set to ON or OFF in response to selection of the manipulator; fixing switches indicating whether keys on the belonging keyboard selected are available or unavailable; and causing the pipes in a selected rank of the ranks to generate a tone for a depressed key in response to determining that the data structure indicates for one of the manipulators the selected rank, the belonging keyboard as the keyboard including the depressed key, that the pipe stop switch as ON, and that the fixing switch for the depressed key indicates that the key is available.

BRIEF DESCRIPTION OF THE DRAWINGS

FIG. 3 is an embodiment of a table schematically showing a data structure of set data.

DETAILED DESCRIPTION

Figure 1:
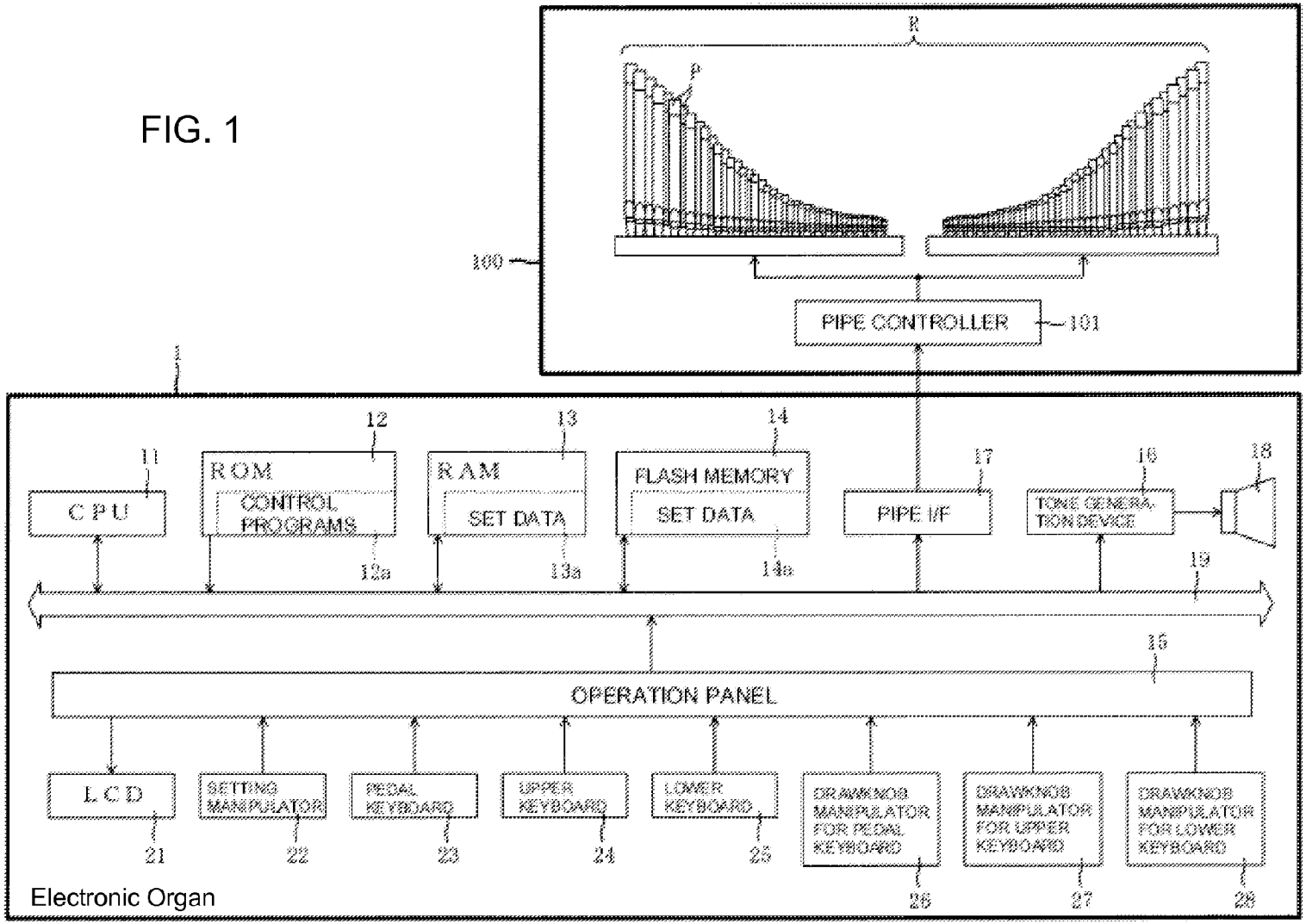
FIG. 1 is a block diagram showing an embodiment of an electrical configuration of an electronic organ with a built-in tone control device.

A pipe organ is configured in such a way that, when malfunction occurs in one of the pipes, a row of pipes that include the pipe is prevented from being used, as the row of pipes cannot be used for performance. In this case, the timbre selection is restricted, such that it is not possible to perform with such a timbre as intended by the user. Because it is not easy to repair or replace the pipe, the user cannot perform as intended for a considerably long time.

One type of the combination organs, such as the electronic organ described in U.S. Pat. No. 7,777,116, may not be provided with pipes for a part of the register in the bass region or the treble region, and such a register is substituted by electronic sounds. In the conventional combination organ, if one of the installed pipes has trouble, tone generation from a row of pipes including the troubled pipe is stopped and, instead, electronic sound corresponding to the row of pipes concerned is generated from the sound source. However, in this case, because the electronic sound is different from the characteristic sound of tone generated from the pipes, the user cannot perform as intended for a considerably long time.

To address the circumstances described above, described embodiments provide a tone control device for a musical instrument that generates tone, when keys are depressed, from pipes corresponding to the keys depressed, which enables the user to promptly resume performance as intended, even when malfunction occurs in the pipes installed.

In certain described embodiments, a tone control device is built in or connected with a musical instrument that includes a plurality of pipes capable of generating tones with differing pitches, formed into one or a plurality of rows of pipes. The tone generation device generates tone from a pipe that belongs to a row of pipes designated as a tone generation subject with a pitch corresponding to a key depressed. When the key depressed is a key corresponding to a specified pipe designated by the pipe designation device, and the specified pipe is a pipe belonging to a row of pipes designated as a tone generation subject, the control device causes the tone generation device to generate a substituting tone corresponding to the specified pipe. As a result, the substituting tone corresponding to the specified pipe is generated by the tone generation device. Therefore, if a problems occur with an installed pipe, the pipe with the trouble may be designated as a specified pipe, and a substituting tone corresponding to the pipe with the trouble can be generated in the unit of a pipe that comprises a row of pipes. Moreover, because other pipes, which belong to the same row of pipes as the pipe with the trouble, can be used as is, while generating the substituting tone for the pipe with the trouble, the characteristic sound of the tone to be generated from the pipes may be maintained. Therefore, with described embodiments, even when an installed pipe experiences problems, the performance as intended by the user can be restarted at an early stage, without repairing or replacing the pipe.

In a further embodiment, the specified pipe is designated by designating a row of pipes to which the specified pipe belongs, and a key corresponding to the specified pipe. Typically, when there is a problem with an organ pipe, the user experiences an uncomfortable feeling when depressing a corresponding key. Therefore a pipe with a problem can be readily designated by designating a corresponding key. Designation of a key corresponding to a specified pipe may include designating a pitch corresponding to the specified pipe.

In a further embodiment, the specified pipe is designated by depressing a key corresponding to the specified pipe in a state in which a row of pipes to which the specified pipe belongs is designated as a tone generation subject. In this way, a pipe having problems can be designated while listening to the tone generated from the pipe.

In a further embodiment, a setting memory device may store, for each row of pipes, associated with each key, information indicative of whether a substituting tone corresponding to a pipe that corresponds to the key is to be generated. When the setting memory device stores information indicating to generate a substituting tone with respect to a key depressed in a row of pipes designated as a tone generation subject, the control device causes the tone generation device to generate a substituting tone corresponding to the specified pipe. Therefore, even when multiple rows of pipes are provided, the use of a substituting tone for each key (in other words, each of the pipes belonging to each row of pipes) can be managed for each of the rows of pipes.

In a further embodiment, when the pipe designation device designates the specified pipe by designating a row of pipes to which the specified pipe belongs and a key corresponding to the specified pipe, a changing device may change information corresponding to the designated key in the designated row of pipes, among pipe information stored in the setting memory device, to indicate to generate the substituting tone. Therefore, pipe information stored in the setting memory device can be readily changed by designation of a row of pipes and designation of a key to information indicating to generate a substituting tone. Note that designation of a key corresponding to a specified pipe includes designating a pitch corresponding to the specified pipe.

In a further embodiment, a setting device may set a characteristic parameter of a substituting tone corresponding to a specified pipe to be generated by the tone generation device. Even when tone is generated by other pipes that belong to the same row of pipes as the specified pipe, while generating the substituting tone for the specific pipe, the substituting tone can be adjusted without causing the user to experience an uncomfortable feeling. Therefore, performance that compares favorably with the case where tone is generated with all the pipes can be executed.

In a further embodiment, the characteristic parameter of a substituting tone to be set by the setting device is at least one of sound level, timbre and pitch parameters. Therefore, the sound level, timbre or pitch of the substituting tone can be suitably adjusted.

Embodiments of the invention will be described below with reference to the accompanying drawing. FIG. 1 is a block diagram showing an electric composition of an electronic organ 1 with a built-in tone control device. The electronic organ 1 is capable of generating tones of a pipe organ with a tone generation device 16 as electronic sounds (digital sounds), and may be composed as a combination organ that can generate tones from pipes in a manner similar to a pipe organ, when the electronic organ 1 is connected with a pipe unit 100. In described embodiments, even when trouble such as breakdown occurs in pipes installed in the pipe unit 100, the user can restart performance as intended of the electronic organ 2 at an early stage using the built-in tone control device.

The electronic organ 1 has a CPU 11, a ROM 12, a RAM 13, a flash memory 14, an operation panel 15, a tone generation device 16, and a pipe I/F (pipe interface) 17 and a speaker 18, as shown in FIG. 1. The parts 11-17 are mutually connected through a bus line 19. The speaker 18 is connected with the tone generation device 16.

The electronic organ 1 has an LCD 21, setting manipulators 22, a pedal keyboard 23, an upper keyboard 24, a lower keyboard 25, drawknob manipulators 26 for the pedal keyboard, drawknob manipulators 27 for the upper keyboard, and drawknob manipulators 28 for the lower keyboard. These parts 21-28 are connected with the operation panel 15. Note that the tone control device of the embodiment is composed of the CPU 11, the ROM 12, the RAM 13, the flash memory 14, the tone generation device 16, the operation panel 15, the LCD 21, and the setting manipulator 22.

The CPU 11 is a central control device that controls each of the parts of the electronic organ 1 according to fixed value data and control programs stored in the ROM 12 and the RAM 13. Also, in embodiments of the electronic organ 1, when keys of the keyboards 23-25 are depressed, the CPU 11 outputs key-depression information corresponding to each of the keys depressed to a pipe controller 101. As a result, among one or a plurality of rows of pipes (hereafter, the unit of each row of pipes is called a "rank") that the pipe system 100 has, pipes corresponding to keys that are depressed and belong to a rank set to be the subject of tone generation can be made to generate tone. On the other hand, when keys on each of the keyboards 23-25 are depressed, a tone generation instruction to generate electronic sound is output to the tone generation device 16 to generate electronic sound corresponding to the keys that are depressed based on set data 13*a*.

When the user operates the drawknob manipulators 26-28 associated with tone generation by the pipe system 100, the CPU 11 sends System Exclusive according to the operation of those drawknob manipulators to the pipe controller 101. As a result, a rank among the ranks of the pipe system 100 associated with any of the drawknob manipulators 26-28 operated can be set as the subject of tone generation, or released from the subject of tone generation.

The ROM 12 is a non-rewritable memory, and stores control programs 12*a* to be executed by the CPU 11, and fixed value data (not shown), etc. that are to be referred to by the CPU 11 when the control programs 12*a* are executed. Note that each processing shown in the flow charts of FIG. 9 and FIG. 10 may be executed by the control program 12*a*.

The RAM 13 is a rewritable memory, and has a temporary area to store various data temporarily when the CPU 11 executes the control programs 12*a*. The temporary area of the RAM 13 is provided with, for example, STOP flags (not shown) that memorize operation states of the drawknob manipulators 26-28 operated by the user.

Also, the set data 13*a* is stored in the temporary area of the RAM 13. The set data 13*a* and set data 14*a* to be described later are data for setting tone to each of the drawknob manipulators 26-28. Detailed data structure of the set data 13*a* and 14*a* will be described later referring to FIGS. 3-5.

The flash memory 14 is a rewritable nonvolatile memory. The set data 13*a* is stored in the flash memory 14 as the set data 14*a*. When the power supply to the electronic organ 1 is turned on, the set data 14*a* stored in the flash memory 14 is written in the RAM 13 as the set data 13*a*. When a change instruction is provided from the user, the set data 13*a* is suitably rewritten based on the change instruction. Also, when there is a predetermined store instruction or the power supply to the electronic organ 1 is turned off, the set data 13*a* stored in the RAM 13 is stored in the flash memory 14 as the set data 14*a*.

The operation panel 15 functions as an interface for inputting and outputting various information and various set values, etc. to the LCD 21, the setting manipulators 22, each of the keyboards 23-25, and each of the drawknob manipulators 26-28. A sub-CPU (not shown) is installed in the operation panel 15, and the sub-CPU controls input and output of various information and various set values.

The LCD 21 is a display device that has a screen where various information and various set values are displayed. The setting manipulators 22 are manipulators that are operated by the user to select various set values displayed in the LCD 21, and make changes and decisions on the values with respect to the selected set values. In the present embodiment, the setting manipulators 22 are each composed of a rotary encoder with a pushbutton, but may be any type of manipulator as long as the manipulator can select set values and change set values.

The pedal keyboard 23 is a keyboard operated with the feet by the user. In the present embodiment, the pedal keyboard 23 is composed of thirty-two keys with the lowest note being C, but may be composed of any pedal keyboard in various key ranges, such as, thirty keys, etc. Both of the upper keyboard 24 and the lower keyboard 25 are keyboards (manuals) operated with the hands by the user, and the upper keyboard 24 is arranged in a row higher than the lower keyboard 25. In one embodiment, the upper keyboard 24 and the lower keyboard 25 are each composed of a key range of five octaves with the lowest note being C, in other words, sixty-one keys, but they may be composed of manuals of various key ranges, such as, fifty-six keys, fifty-eight keys, and the like.

The drawknob manipulators 26 for the pedal keyboard are manipulators operated by the user, for specifying a rank of timbre that is subject to tone generation based on key-depression from among ranks whose tone can be generated by the pedal keyboard 23. The drawknob manipulators 26 for the pedal keyboard are provided only in the number of kinds of timbre (ten kinds, in the embodiment) whose tone can be generated by the pedal keyboard 23. The drawknob manipulators 27 for the upper keyboard are manipulators operated by the user, for specifying a rank of timbre that is subject to tone generation based on key-depression from among ranks whose tone can be generated by the upper keyboard 24. The drawknob manipulators 27 for the upper keyboard are provided only in the number of kinds of timbre (ten kinds, in the embodiment) whose tone can be generated by the upper keyboard 24. The drawknob manipulators 28 for the lower keyboard are manipulators operated by the user, for specifying a rank of timbre that is subject to tone generation based on key-depression from among ranks whose tone can be generated by the lower keyboard 25. The drawknob manipulators 28 for the lower keyboard 25 are provided only in the number of kinds of timbre (ten kinds, in the embodiment) whose tone can be generated by the lower keyboard 25.

The drawknob manipulators 26-28 may comprise drawknob manipulators known in the art. In one embodiment, the drawknob manipulators are each biased to a standard position in the normal state, and use a switch to detect draw-out operation or push-in operation performed by the user. When the draw-out operation is performed once to a drawknob manipulator corresponding to a rank that is subject to non-tone generation (i.e., a drawknob manipulator that is in OFF state), the rank corresponding to the drawknob manipulator is placed in a tone generation state. On the other hand, while the user-interface U1 (see FIG. 7) to be described later is being displayed, and the draw-out operation is performed two times to a drawknob manipulator that is in OFF state, the drawknob manipulator is selected as a target to change the set value. The drawknob manipulator selected as the target to change the set value sets its corresponding rank in a tone generation state by the first draw-out operation among the two draw-out operations. Therefore, according to the electronic organ 1 of the embodiment, sound for the rank corresponding to the drawknob manipulator to which the second draw-out operation is performed can be adjusted, in a state in which plural ranks corresponding to plural ones of the drawknob manipulators are placed in the tone generation state thereby combining sounds.

The tone generation device 16 generates tone based on a tone generation instruction from the CPU 11 and, more specifically, generates digital tone with pitch and timbre based on keys depressed in each of the keyboards 23-25 and the set data 13*a*. The tone generation device 16 of the embodiment is composed as a PCM sound source, but can use a sound source of various methods, such as, a physical model sound source, etc.

Digital tone generated by the tone generation device 16 is converted into an analog signal by a digital-to-analog converter (not shown), and output from the speaker 18.

The pipe I/F 17 is an interface to connect with the pipe controller 101 of the pipe unit 100. The pipe I/F 17 converts various data such as key-depression information, System Exclusives, etc. output from the CPU 11 into current-loop serial data signals, and output the same to the pipe controller 101.

The pipe unit 100 is composed of the pipe controller 101 and ranks R (rows of pipes) formed from real pipes P connected with the pipe controller 101. Each of the ranks R is composed of a plurality of real pipes P with differing pitches. One or multiple ranks R corresponding to timbre as desired by the user can be set up in the pipe unit 100. The rank R thus set becomes the subject of tone generation, when draw-out operation is performed to the corresponding drawknob manipulator among the drawknob manipulators 26-28. Depending on the type of the drawknob manipulators, multiple ranks R may become the subject of tone generation along with the draw-out operation. Note that, with respect to one key, plural ones of the ranks R may often be set as the subject of tone generation such that these ranks R sound different octaves, respectively. This is generally referred to as a mixture stop. On the other hand, the rank R that is set as the subject of tone generation becomes the subject of non-tone generation, when push-in operation is performed to the corresponding drawknob manipulator.

When a key on a keyboard (any one of the keyboards 23-25) to which the rank R specified as the subject of tone generation belongs is depressed, tone is generated from a real pipe P with a pitch corresponding to the key depressed, from among the plurality of real pipes P composing that rank R. When multiple ranks R are designated by draw-out operation of the drawknob manipulator as the subject of tone generation (i.e., a mixture stop is designated), upon key depression, tone is generated from the real pipe P in each of the multiple ranks R corresponding to the key depressed. Therefore, in this case, tone is generated from multiple ones of the real pipes P. Moreover, though details will be described later, the electronic organ 1 is composed such that a part of the register on the bass region side or the treble region side among the real pipes P composing the rank R is not provided with real pipes R, but tones to be generated from the corresponding real pipes P can be generated by the tone generation device 16.

The pipe controller 101 controls tone generation of each of the ranks R set up based on serial data signals received from the pipe I/F 17. For example, when a System Exclusive serial data signal based on the draw-out operation of the drawknob manipulators 26-28 is received from the pipe I/F 17, the pipe controller 101 sets corresponding one or plural ranks R as the subject of tone generation. When a key in a keyboard (any one of the keyboards 23-25) to which the rank R designated as the tone generation subject is depressed, the pipe controller 101 controls an electromagnetic valve (not shown in the figure) and an air supply device (not shown in the figure), thereby driving pressurized air to a real pipe P corresponding to the key depressed. By such a control, tone is generated from the corresponding real pipe P.

On the other hand, when a System Exclusive serial data signal based on the push-in operation of the drawknob manipulators 26-28 is received from the pipe I/F 17, the pipe controller 101 sets the corresponding rank R as the subject of non-tone generation. As for the rank R set as the subject of non-tone generation, the pipe controller 101 controls an electromagnetic valve (not shown in the figure) and an air supply device (not shown in the figure) such that, even when a key in a keyboard (any one of the keyboards 23-25) to which the rank R belongs is depressed, pressurized air is not sent to the real pipe P corresponding to the depressed key. The corresponding real pipe P does not generate tone due to the control described above.

Figure 2C:
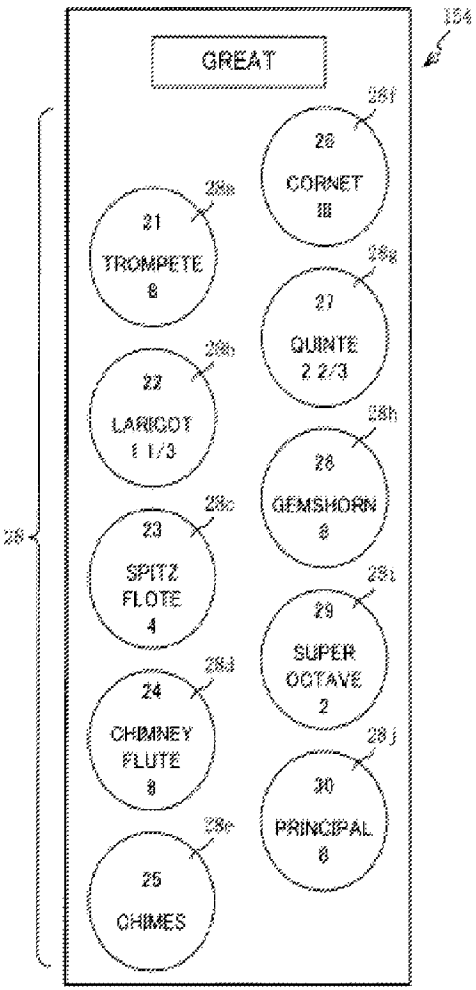
FIGS. 2*a*, 2*b*, 2*c* provide embodiments of a schematic front view of an operation panel in which drawknob manipulators for a pedal keyboard, drawknob manipulators for an upper keyboard, and drawknob manipulators for a lower keyboard are arranged.
Figure 2B:
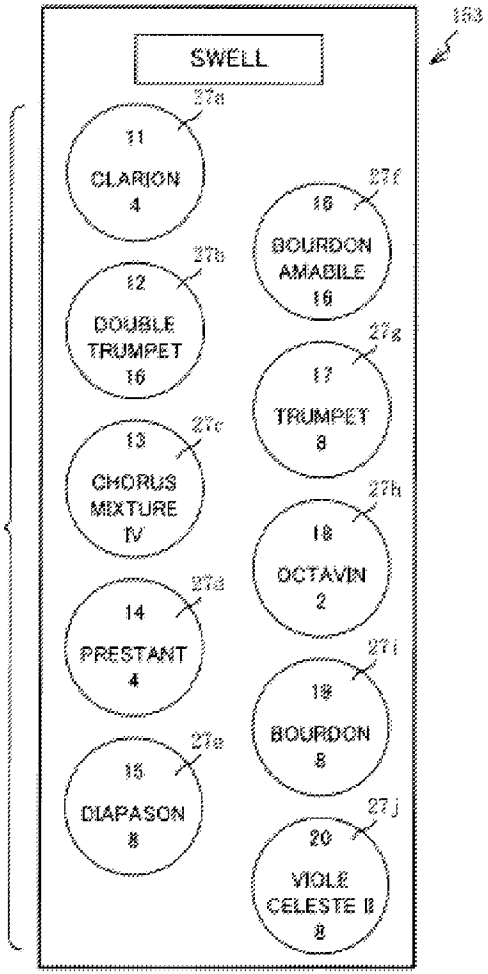
Figure 2A:
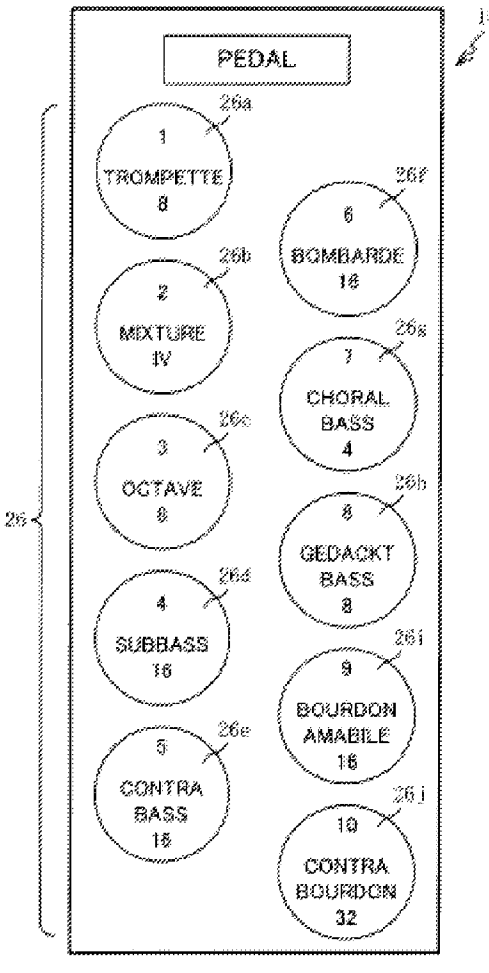

Referring to FIGS. 2*a*, 2*b*, 2*c*, each of the drawknob manipulators 26-28 will be described. First, FIG. 2*a* is a schematic front view of a manipulator panel 152 in which the drawknob manipulators 26 for the pedal keyboard are arranged. In this embodiment, ten drawknob manipulators 26 (26*a*-26*j*) for the pedal keyboard are arranged in the manipulator panel 152 in a staggered fashion. Each of the drawknob manipulators 26 for the pedal keyboard is associated with one or a plurality of ranks capable of generating one kind of timbre. Therefore, by operating the ten drawknob manipulators 26*a*-26*j* for the pedal keyboard, respectively, tone can be generated from ranks with timbre, among ten kinds of timbre, corresponding to the operated drawknob manipulators. On the front face of each the drawknob manipulators 26*a*-26*j*, a "drawknob number" that specifies the drawknob manipulator is written in the upper row, and a "stop name" that is a name indicating its corresponding one or plural ranks, is written in the lower row. For example, "6" is inscribed on the sixth drawknob manipulator 26*f* as the drawknob number among the drawknob manipulators 26 for the pedal keyboard, and "BOMBARDE 16" is written as the stop name. In other words, the drawknob manipulator 26*f* is a drawknob manipulator corresponding to the rank of "BOMBARDE 16". Drawknob numbers from "1" to "10" are assigned to the ten drawknob manipulators 26*a*-26*j* for the pedal keyboard, respectively, as shown in FIG. 2*a*.

FIG. 2*b* is a schematic front view of a manipulator panel 153 in which the drawknob manipulators 27 for the upper keyboard are arranged. In this embodiment, ten drawknob manipulators 27 (27*a*-27*j*) for the upper keyboard are arranged in the manipulator panel 153 in a staggered fashion. Each of the drawknob manipulators 27 for the upper keyboard is associated with one or plural ranks capable of generating one kind of timbre. Therefore, by operating the ten drawknob manipulators 27*a*-27*j* for the upper keyboard, respectively, tone can be generated from ranks with timbre, among ten kinds of timbre, corresponding to the operated drawknob manipulators. On the front face of each the drawknob manipulators 27*a*-27*j*, a "drawknob number" is written in the upper row, and a "stop name" is written in the lower row, similarly to the drawknob manipulators 26 for the pedal keyboard. Drawknob numbers from "11" to "20" are assigned to the ten drawknob manipulators 27*a*-27*j* for the upper keyboard, respectively, as shown in FIG. 2*b*.

FIG. 2*c* is a schematic front view of a manipulator panel 154 in which the drawknob manipulators 28 for the lower keyboard are arranged. In this embodiment, ten drawknob manipulators 28 (28*a*-28*j*) for the lower keyboard 25 are arranged in the manipulator panel 154 in a staggered fashion. Each of the drawknob manipulators 28 for the lower keyboard 25 is associated with one or plural ranks capable of generating one kind of timbre. Therefore, by operating the ten drawknob manipulators 28*a*-28*j* for the lower keyboard, respectively, tone can be generated from ranks with timbre, among ten kinds of timbre, corresponding to the operated drawknob manipulators. On the front face of each the drawknob manipulators 28*a*-28*j*, a "drawknob number" is written in the upper row, and a "stop name" is written in the lower row, similarly to the drawknob manipulators 26 for the pedal keyboard. Drawknob numbers from "21" to "30" are assigned to the ten drawknob manipulators 28*a*-28*j* for the lower keyboard, respectively, as shown in FIG. 2*c*.

Figure 4:
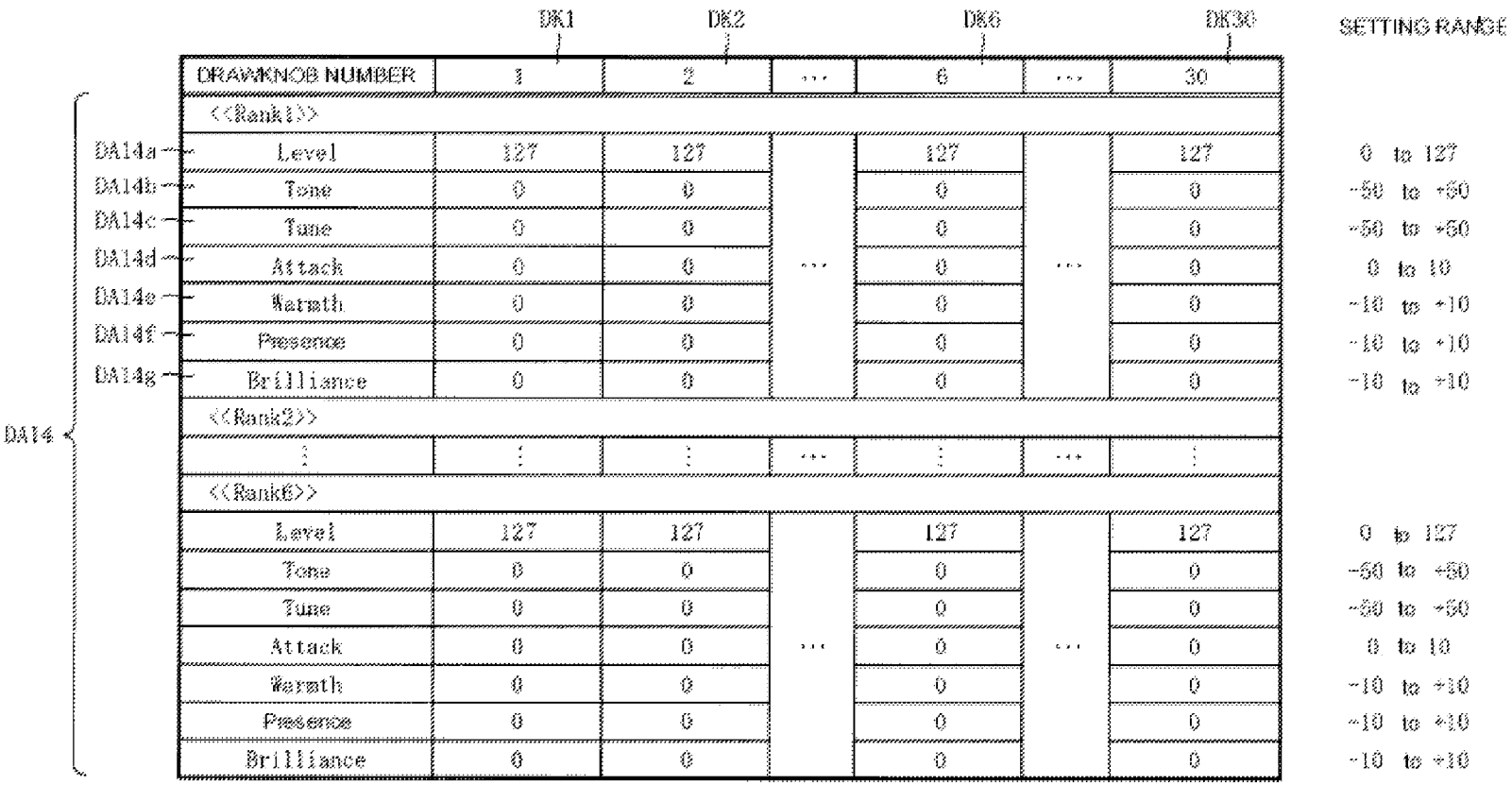
FIG. 4 is an embodiment of a table schematically showing a data structure of set data.
Figure 5:
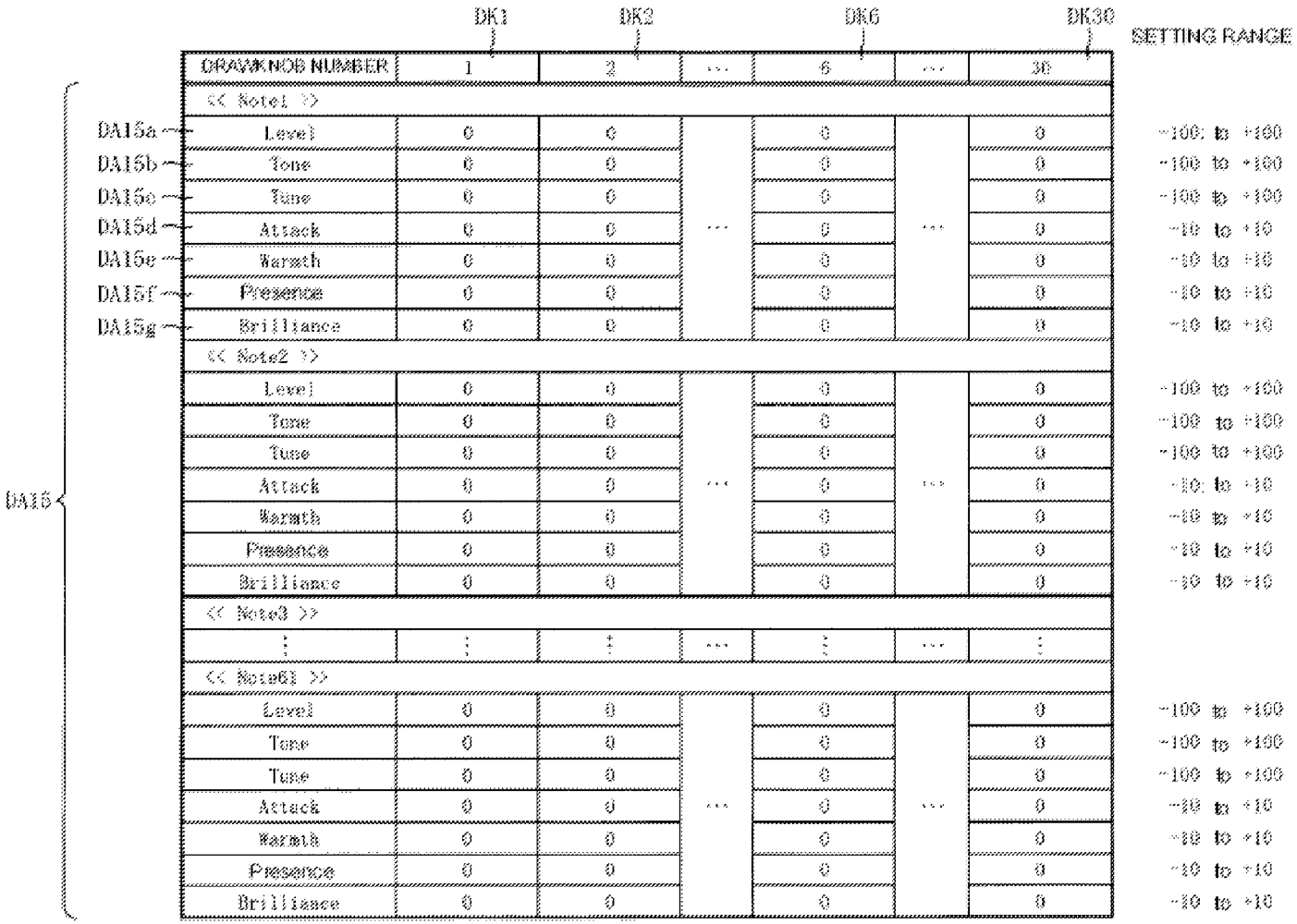
FIG. 5 is an embodiment of a table schematically showing a data structure of set data.

The data structure of the set data 13*a* and 14*a* will be described with reference to FIG. 3 to FIG. 5. FIG. 3 through FIG. 5 are tables schematically showing the data structure of the set data 13*a* and 14*a*. The set data 13*a* and 14*a* are structured into a matrix that associates various data DA1-DA15 to the drawknob numbers DK1-DK30 of "1"-"30" assigned to the respective drawknob manipulators 26-28. With respect to FIG. 3, Data DA1 (Stop Name) is data that indicates a stop name corresponding to each of the drawknob numbers DK1-DK30. Stop Name stored as data DA1 for each of the drawknob numbers DK1-DK30 is the stop name written on the front face of the 30 drawknob manipulators 26-28 that correspond to the drawknob numbers DK1-DK30, respectively. Data DA2 (Timbre Number) is data that indicates a timbre number of the electronic sound corresponding to the stop name, and a value among values from "1" to "128" corresponding to the corresponding timbre is stored.

Data DA3 (Belonging Keyboard) is data that indicates a keyboard to which each of the drawknob numbers DK1-DK30 belongs. Among "PEDAL" indicating to belong to the pedal keyboard 23, "SWELL" indicating to belong to the upper keyboard 24, and "GREAT" indicating to belong to the lower keyboard 25, a corresponding value is stored as data DA3. Because the drawknob numbers from "1" to "10" are assigned to the drawknob manipulators 26*a*-26*j* for the pedal keyboard, respectively, in the embodiment, "PEDAL" is stored as data DA3 for the drawknob numbers DK1-DK10. Also, because the drawknob numbers from "11" to "20" are assigned to the drawknob manipulators 27*a*-27*j* for the upper keyboard, respectively, "SWELL" is stored as data DA3 for the drawknob numbers DK11-DK20. Moreover, because the drawknob numbers from "21" to "30" are assigned to the drawknob manipulators 28*a*-28*j* for the lower keyboard, respectively, "GREAT" is stored as data DA3 for the drawknob numbers DK21-DK30.

Data DA4 (Pipe Stop Switch) is data that indicates as to whether a rank R (a rank of real pipes) in the pipe unit 100 is set to each of the drawknob manipulators 26-28 corresponding to the respective drawknob numbers DK1-DK30. Either "ON" indicating that the rank R is set or "OFF" indicating that it is not so is stored as data DA4. Data DA5 (Pipe Stop Number) is data that stores the number specifying one or plural ranks R set to each of the drawknob manipulators 26-28 corresponding to the respective drawknob numbers DK1-DK30. In the embodiment, among values from "1" to "300", one of the values corresponding to the subject rank R is stored independently for each of the respective drawknob numbers DK1-DK30 as data DA5.

When "ON" is stored as data DA4 for a drawknob number (any of DK1-DK30) corresponding to a drawknob manipulator drawn out by the user, the electronic organ 1 of the embodiment generates tone from one or plural ranks R indicated by the corresponding data DA5, along with key-depression on a keyboard (any of the keyboards 23-25) to which the drawknob manipulator belongs. On the other hand, when "OFF" is stored as data DA4 for a drawknob number corresponding to the drawknob manipulator drawn out by the user, the electronic organ 1 causes the tone generation device 16 to generate electronic sound with a pitch corresponding to a key depressed, with a timbre of the timbre number specified by the aforementioned data DA2 along with key-depression on a keyboard to which the drawknob manipulator belongs.

Data DA6 (Extension Switch) is data that specifies as to whether to generate electronic sound from the tone generation device 16 which replaces a real pipe P in a part of the register on the bass region side or on the treble region side, when a rank R is set in the pipe unit 100 (in other words, when data DA4 is "ON"). As data DA6, either "ON" indicating to generate electronic sound from the tone generation device 16 which replaces the real pipe P in a part of the register on the bass region side or on the treble region side or "OFF" indicating not to do so is stored.

Data DA7 (Extn PC) is data that indicates a timbre number to be applied to electronic sound that replaces a real pipe P in a part of the register on the bass region side or on the treble region side, when data DA6 is set to "ON", for each of the drawknob manipulators 26-28 corresponding to the respective drawknob numbers DK1-DK30. As data DA7, "OFF" indicating to use the timbre number of data DA2, or a value among values from "1" to "128" corresponding to timbre to be used as the timbre of the electronic sound is stored.

Data DA8 (Lo Extn Limit) is data that specifies a register on the bass region side where electronic sound that replaces a real pipe P is to be generated, when data DA6 is set to "ON". On the other hand, data DA9 (Hi Extn Limit) is data that specifies a register on the treble region side where electronic sound that replaces a real pipe P is to be generated, when data DA6 is set to "ON". As data DA8 and data DA9, "OFF" indicating that electronic sound is not to be generated in the corresponding register, or a register designated by note numbers (C1-C61) specifying a keyboard position of keys is stored.

In other words, a register from the lowest note C1 to a set value is stored in data DA8 (Lo Extn Limit), and a register from a set value to the highest note C C61 is stored in data DA9 (Hi Extn Limit). For example, in FIG. 3, "C1-B12" is stored to the drawknob number DK6 as data DA8 (Lo Extn Limit). This indicates that, in the rank R set to the drawknob number DK6, electronic sound is generated from the tone generation device 16, not from the corresponding real pipes P, in the register from the lowest note C1 to B12.

The real pipes P might not be able to be set up depending on where they are installed because, the lower the pitch, the heavier and thicker the pipes become. On the other hand, the higher the pitch, the smaller and less conspicuous the real pipes become, so they may not have apparent influence even if they are not installed. Therefore, according to the electronic organ 1 of one embodiment, when the real pipes P in the bass region or in the treble region are not set up, data DA6 is set to "ON", and the register in which the real pipes P are not installed may be set at data DA8 and/or data DA9, whereby the tone in the set register can be generated as electronic sound.

Data DA10 (Fixing Note) is data that indicates, for each key that composes the keyboards 23-25 to which each of the drawknob numbers DK1-DK30 belongs, as to whether the real pipe P corresponding to the key is the subject of pipe fixing (in other words, the subject of repair). As data DA10, either "ON" indicating that it is the subject of pipe fixing, or "OFF" indicating that it is not so is stored.

Because data DA10 is data set to each key, there are data for 61 keys, which is the largest number of keys among the numbers of keys each composing each of the keyboards 23-25. The figures "#1"-"#61" following the "Fixing Note" correspond to the lowest note (C1) to the highest note (C61) in the keyboard of 61 keys, respectively. However, because the pedal keyboard 23 is a keyboard with 32 keys, data DA10 corresponding to the drawknob numbers whose data DA3 (Belonging Keyboard) is "PEDAL" are assumed to be effective for 32 keys, in other words, from "Fixing Note#1" to "Fixing Note #32."

Though details are described later, according to the electronic organ 1 with the built-in tone control device of the embodiment, when a key is depressed in the keyboards 23-25, and when the key depressed is a key whose data DA10 is stored as "ON", and the real pipe P corresponding to the key depressed belongs to the rank R designated as the subject of tone generation, electronic sound that replaces the corresponding real pipe P is generated from the tone generation device 16. Therefore, when trouble such as breakdown or the like occurs in a real pipe P set up in the pipe unit 100, the real pipe P having the trouble may be set (designated) at data DA10 as the subject of pipe fixing, whereby electronic sound (substituting tone) that replaces the real pipe P with the trouble can be generated in the unit of each of the real pipes P that compose the rank R.

The set data 13*a* and 14*a* are composed, for each of the drawknob numbers, in a manner to store data (data DA10) that indicates whether each real pipe P corresponding to each key is the subject of pipe fixing. Therefore, even when multiple ranks R (rows of pipes) are set in the pipe unit 100, the use of a substituting tone for each of the keys (that is, each of the real pipes P that belongs to the corresponding rank R) can be managed, for each of the drawknob numbers (that is, the rank R corresponding to each of the drawknob manipulators).

Data DA11 (Extn Level) is data for setting the sound level of the electronic sound that is to be generated from the tone generation device 16, for each of the drawknob manipulators 26-28 corresponding to the respective drawknob numbers DK1-DK30. As data DA11, a value within the range from the minimum level "0" to the maximum level "127" is stored.

Data DA12 (Extn Tone) is data for setting the brightness of the electronic sound to be generated from the tone generation device 16, for each of the drawknob manipulators 26-28 corresponding to the respective drawknob numbers DK1-DK30. When the default brightness of the electronic sound is used as is, "0" is stored. As data DA12, a value within the range from "−50" to "+50" is stored. The greater the value, the brighter the sound becomes, and the smaller the value, the darker the sound becomes.

Data DA13 (Extn Tune) is data for setting the pitch of the electronic sound to be generated from the tone generation device 16, for each of the drawknob manipulators 26-28 corresponding to the respective drawknob numbers DK1-DK30. When the default pitch of the electronic sound is not changed, "0" is stored. As data DA13, a value within the range from the lowest pitch "−50" to the highest pitch "+50" is stored.

Data DA4-DA13, among the above-described data DA1-DA13, can be suitably changed by the user, using the interface U1 (see FIG. 7) to be described later. Therefore, when trouble occurs in a real pipe P, it can be promptly substituted by electronic sound, because the user can suitably set the subject of pipe fixing if necessary.

Next, each data shown in FIG. 4 will be described. Data DA14 is data for setting the sound level and the tone quality of electronic sound corresponding to each of the drawknob numbers DK1-DK30. Data DA14 is composed of seven data DA14a-DA14g for setting the sound level and the tone quality of electronic sound to each of voices (Rank1-Rank6) each composing electronic sound for each of the drawknob numbers DK1-DK30. It is composed such that data DA14a-DA14g can be stored for each of the six voices (Ranks), for each of the drawknob numbers DK1-DK30. However, sets of data DA14a-DA14g according to the number of voices to be used are assumed to be effective data. Data DA14a-DA14g can be suitably changed by the user, using the user interface U2 (see FIG. 7) to be described later.

Data DA14a (Level) is data for setting the level of electronic sound of the corresponding voice (Rank), and stores a value within the range from the minimum level "0" to the maximum level "127". Data DA14b (Tone) is data for setting the brightness of electronic sound of the corresponding voice, and when the corresponding default brightness of the electronic sound is used as is, "0" is stored. A value within the range from "−50" to "+50" is stored as data DA14b. The greater the value, the brighter the sound becomes, and the smaller the value, the darker the sound becomes.

Data DA14c (Tune) is data for setting the pitch of electronic sound of the corresponding voice. When the corresponding default pitch of the electronic sound is not changed, "0" is stored. As data DA14c, a value within the range from the lowest pitch "−50" to the highest pitch "+50" is stored. Data DA14d (Attack) is data for setting the attack time of electronic sound of the corresponding voice (the time from the moment of rising of tone generated by the tone generation device 16 based on key-depression to the maximum sound level), and stores one of values between "0" and "10".

Data DA14e (Warmth) is data for setting EQ (equalizer) in the bass region of electronic sound of the corresponding voice. When the corresponding default EQ of the bass region is used, "0" is stored. One of values between "−10" and "+10" is stored as data DA14e. Data DA14f (Presence) is data for setting EQ of the midrange of electronic sound of the corresponding voice. When the corresponding default EQ of the midrange is used, "0" is stored. One of values between "−10" and "+10" is stored as data DA14f. Data DA14g (Brilliance) is data for setting EQ of the treble range of electronic sound of the corresponding voice, and stores "0" when the corresponding default EQ of the treble range is used. One of values between "−10" and "+10" is stored as data DA14g.

Next, each data shown in FIG. 5 will be described. Data DA15 is data for setting the sound level and the tone quality of electronic sound to be generated by each key, for each of the drawknob numbers DK1-DK30. Data DA15 is composed of seven data DA15a-DA15g for setting the sound level and the tone quality of electronic sound, for each of the keys (Note1-Note61) ranging from C1 to C61. These data DA15a-DA15g are provided corresponding to the above-mentioned data DA14a-DA14g for the six voices (Rank1-Rank6). In other words, data DA15 (DA15a-DA15g) are provided for 61 keys, for each of Rank1-Rank6 of data DA14. It is composed such that, for each of the drawknob numbers DK1-DK30, data DA15a-DA15g for each of the 61 keys can be stored. However, for the drawknob numbers to which "PEDAL" is stored as data DA3 (Belonging Keyboard), sets of data DA15a-DA15g for 32 keys are assumed to be effective data. Data DA15a-DA15g can be suitably changed by the user, using the user interface U3 (see FIG. 8) to be described later.

Data DA15a (Level) is data for setting the level of electronic sound for the corresponding key (Note). When the level set to the entire corresponding voice (Rank), in other words, the level decided according to data DA11 and data DA14a of the corresponding voice (Rank), is used, "0" is stored in data DA15a. One of values between "−100" and "+100 is stored as data DA15a. Data DA15b (Tone) is data for setting the brightness of electronic sound for the corresponding key. When the brightness of electronic sound set to the entire corresponding voice (Rank), in other words, the brightness decided according to data DA12 and data DA14b of the corresponding voice (Rank), is used, "0" is stored in data DA15b. One of values from "−100" to "+100" is stored as data DA15b.

Data DA15c (Tune) is data for setting the pitch of electronic sound for the corresponding key. When the pitch set to the entire corresponding voice (Rank), in other words, the pitch decided according to data DA13 and data DA14c of the corresponds voice (Rank), is used, "0" is stored in data DA15c. One of values between "−100" and "+100" is stored as data DA15c. Data DA15d (Attack) is data for setting the attack time of electronic sound for the corresponding key. When the attack time set to the entire corresponding voice (Rank), in other words, the attack time decided according to data DA14d of the corresponding voice (Rank), is used, "0" is stored in data DA15d. One of values between "−10" and "+10" is stored as data DA15d.

Data DA15e (Warmth) is data for setting EQ (Equalizer) in the bass region of electronic sound for the corresponding key. When EQ in the bass region set to the entire corresponding voice (Rank), in other words, EQ in the bass region decided according to data DA14e of the corresponding voice (Rank), is used, "0" is stored in data DA15e. One of values between "−10" and "+10" is stored as data DA15e. Data DA15f (Presence) is data for setting EQ in the midrange region of electronic sound for the corresponding key. When EQ in the midrange region set to the entire corresponding voice (Rank), in other words, EQ in the midrange region decided according to data DA14f of the corresponding voice (Rank), is used, "0"

is stored in data DA15f. One of values between "−10" and "+10" is stored as data DA15f. Data DA15g (Brilliance) is data for setting EQ in the treble region of electronic sound for the corresponding key. When EQ in the treble region set to the entire corresponding voice (Rank), in other words, EQ in the treble region decided according to data DA14g of the corresponding voice (Rank), is used, "0" is stored in data DA15g. One of values between "−10" and "+10" is stored as data DA15g.

Figure 6:
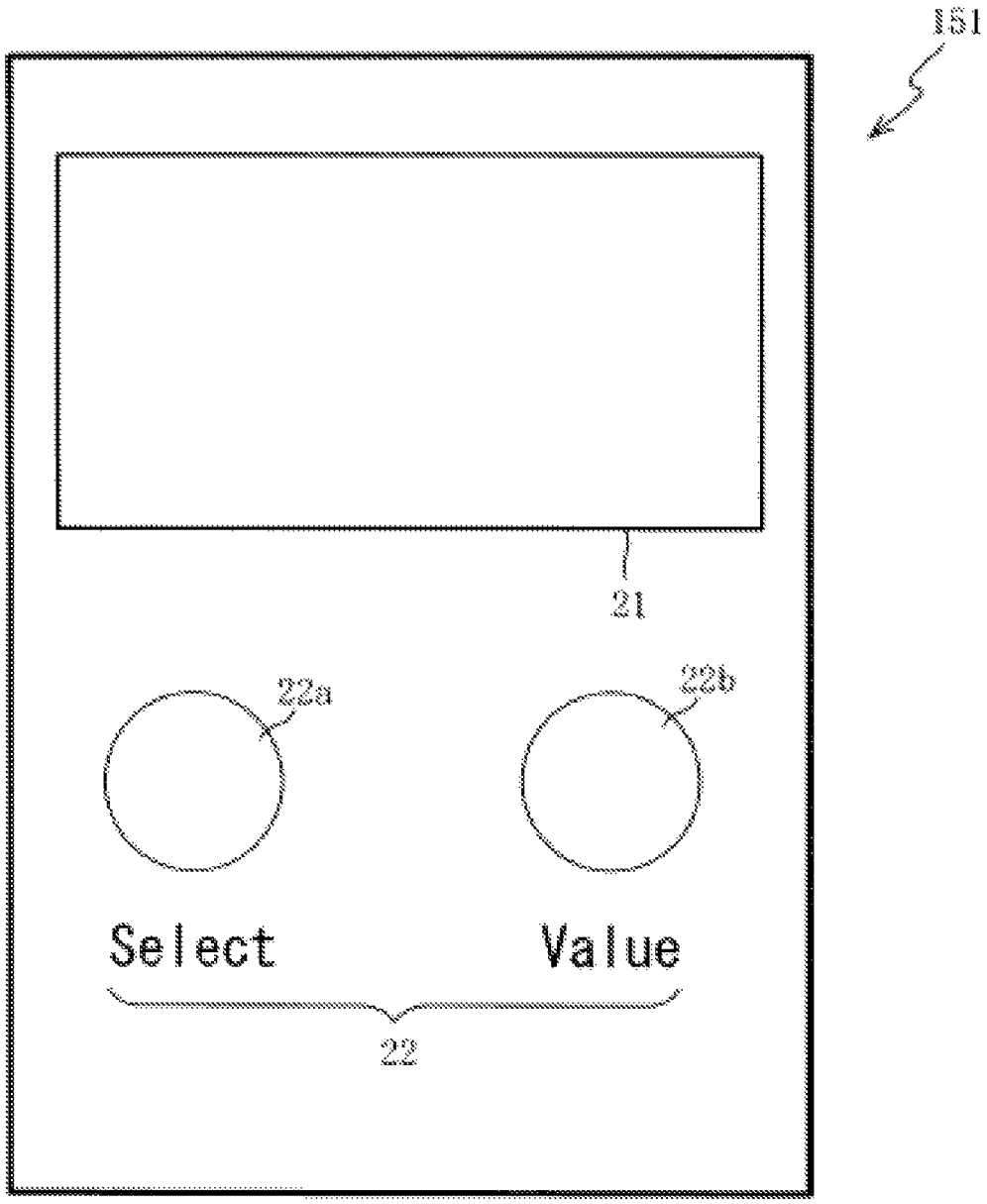
FIG. 6 is an embodiment of schematic front view of a setting panel.

Next, referring to FIG. 6 through FIG. 8, user interfaces for changing settings of the set data 13*a* and 14*a* will be described. FIG. 6 is a schematic front view of a setting panel 151. An LCD 21 and two setting manipulators 22 are installed in the setting panel 151. One of the two setting manipulators 22 is a manipulator 22*a* to move a cursor CU1 (see FIG. 7 and FIG. 8), and the other is a manipulator 22*b* to change the set value. The manipulator 22*a* and the manipulator 22*b* are each composed of a rotary encoder with a pushbutton. The LCD 21 displays user interfaces U1-U3 to be described below referring to FIG. 7 and FIG. 8.

Figure 7A:
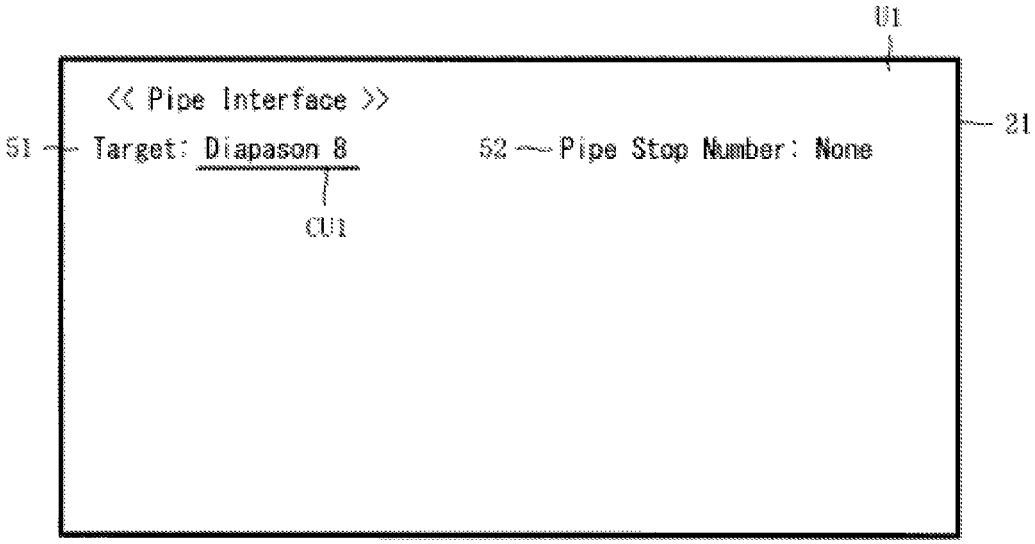
FIGS. 7*a*, 7*b*, 7*c* are schematic illustrations showing display embodiments of user interfaces.
Figure 7B:
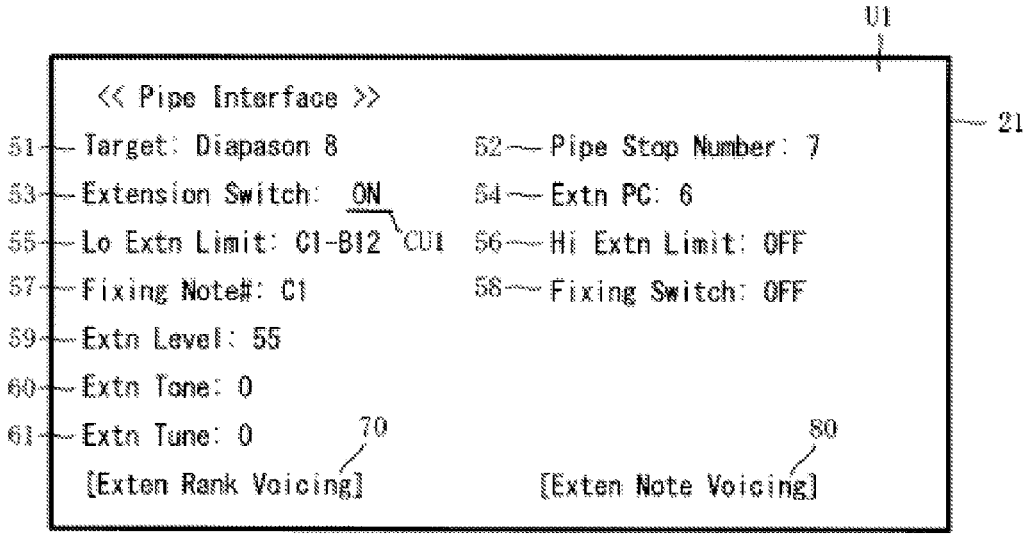

FIG. 7*a* and FIG. 7*b* schematically show display examples of the user interface U1. The user may call the user interface U1 by a predetermined operation, which will be displayed on the LCD 21, and use the interface U1 to change data DA4-DA13 (see FIG. 3) in the set data 13*a* and 14*a*.

In the user interface U1, a stop name (data DA1) stored for a drawknob number being selected in the set data 13*a* is displayed at Item 51 (Target). FIG. 7(*a*) shows an example of the state in which "Diapason 8" is displayed at Item 51, in other words, the drawknob number DK15 is selected. After placing the cursor CU1 to the stop name displayed for Item 51 by rotatably operating the manipulator 22*a*, the stop name can be changed by rotatably operating the manipulator 22*b*, whereby the user can select a stop name (a drawknob number and a drawknob manipulator) to change its set values.

Alternatively, while the user interface U1 is displayed, the user may perform the draw-out operation twice to a drawknob manipulator corresponding to the stop name desired to be selected, for drawknob manipulators 26-28 corresponding to ranks that are subject of non-tone generation, or the user may perform the draw-out operation once to a drawknob manipulator corresponding to the stop name desired to be selected, for drawknob manipulators 26-28 corresponding to ranks that are subject of tone generation. As a result, the stop name in which the user desires to change the set values can be selected. Note that, for the drawknob manipulators 26-28 corresponding to the stop name displayed at Item 51 in the user interface U1, corresponding LEDs (not shown in the figure) may blink, so that the user may find it easy to distinguish that the drawknob manipulators are selected in the user interface U1.

At Item 52 (Pipe Stop Number), information indicative of whether or not a rank R (a rank of real pipes) in the pipe unit 100 is set to the drawknob number being selected (in this example, the drawknob number DK15) is displayed. When "OFF" is stored to the drawknob number being selected as data DA4 in the set data 13*a*, "None" is displayed at Item 52. On the other hand, when "ON' is stored as data DA4 in the set data 13*a*, a value (in the present embodiment, one of values between 1 and 300) stored as data DA5 (Pipe Stop Number) in the set data 13*a* is displayed at Item 52.

After placing the cursor CU1 to the set value for Item 52 by rotatably operating the manipulator 22*a*, and then changing the set value by rotatably operating the manipulator 22*b*, the user can change data DA4 and/or data DA5 for the drawknob number being selected.

More specifically, when the user changes the set value from "None" to a value among 1-300 by rotatably operating the manipulator 22*b* in the state in which the cursor CU1 is placed on the set value at Item 52, Data DA4 (Pipe Stop Switch) for the drawknob number being selected is changed from "OFF" to "ON" in the set data 13*a*, and the value newly set is stored as data DA5 (Pipe Stop Number). On the other hand, when the user changes a set value at Item 52 to a different numerical value within the range of 1-300 by rotatably operating the manipulator 22*b*, the value after the change is stored as data DA5 for the drawknob number being selected. Moreover, when the user changes the set value at Item 52 from a value among 1-300 to "None" by rotatably operating the manipulator 22*b*, data DA4 for the drawknob number being selected is changed from "ON" to "OFF" in the set data 13*a*.

When one of the values of 1-300 is displayed at Item 52, the value of data DA6 for the drawknob number being selected in the set data 13*a* is displayed as Item 53 (Extension Switch). When "ON" is displayed at Item 53, Item 54-Item 61 are displayed, as shown in FIG. 7*b*. On the other hand, when "OFF" is displayed at Item 53, Item 54-Item 61 are not displayed.

With respect to FIG. 7*b*, the values of data DA7, data DA8 and data DA9 for the drawknob number being selected in the set data 13*a* are displayed at Item 54 (Extn PC), Item 55 (Lo Extn Limit) and Item 56(Hi Extn Limit), respectively. Also, the values of data DA11, data DA12 and data DA13 of the drawknob number being selected in the set data 13*a* are displayed at Item 59 (Extn Level), Item 60 (Extn Tone) and Item 61 (Extn Tune), respectively. The user may place the cursor CU1 to the set value at the target item among Items 54, 55, 56, 59, 60, and 61 described above by rotatably operating the manipulator 22*b* and change the set value. As a result, in the set data 13*a*, among data DA7, DA8, DA9, DA11, DA12 and DA13 for the drawknob number being selected, data corresponding to the item to which the set value is changed is changed.

Item 57 (Fixing Note#) is an item that inputs a value to select one data (Fixing Note) among data DA10. The keyboard position of a key within the range of C1-C61 is displayed at Item 57. The user may place the cursor CU1 to the set value at Item 57 by rotatably operating the manipulator 22*a*, and then change the position of the key displayed by rotatably operating the manipulator 22*b* to select the position of one key. Alternatively, by depressing a desired key while the user interface U1 is being displayed, the user can select the position of one key. Data indicative of the position of the selected key among data DA10 is selected by selecting the key by the above-described method. It is desirable to set the value to Item 57 by depressing the key in the state in which the rank R corresponding to the stop name displayed at Item 51 (Target) is specified as the subject of tone generation. In this case, while listening to the state of tone generation of the real pipes P based on actual key-depression, a real pipe P that is subject to pipe fixing can be set at the following Item 58.

Item 58 (Fixing Switch) shows information, with respect to the position of the key displayed at item 57, indicative of whether the real pipe P corresponding to the key is the subject of pipe fixing. More specifically, Item 58 displays "ON" or "OFF" stored corresponding to the position of the key displayed at Item 57, among data DA10 stored in the set data 13*a*. The user may place the cursor CU1 to the set value at Item 58 by rotatably operating the manipulator 22*a*, and then change the set value by rotatably operating the manipulator 22*b*, whereby corresponding data DA10 (that is, value stored corresponding to the position of the key displayed at Item 57) in the set data 13*a* is changed.

When "ON" is displayed at Item 53, a button 70 marked as "Extent Rank Voicing" is displayed. The user may call the user interface U2 (see FIG. 7*c*) by pushing in the manipulator 22*a* while the cursor CU1 is placed on this button 70, whereby the user interface U2 is displayed in the LCD 21 in place of the user interface U1.

When "ON" is displayed at Item 53, a button 80 marked as "Exten Rank Voicing" is displayed. The user may call the user interface U3 (see FIG. 8) by pushing the manipulator 22*a* with the cursor CU1 placed on this button 80, whereby the user interface U3 is displayed in the LCD 21 in place of the user interface U1.

Figure 7C:
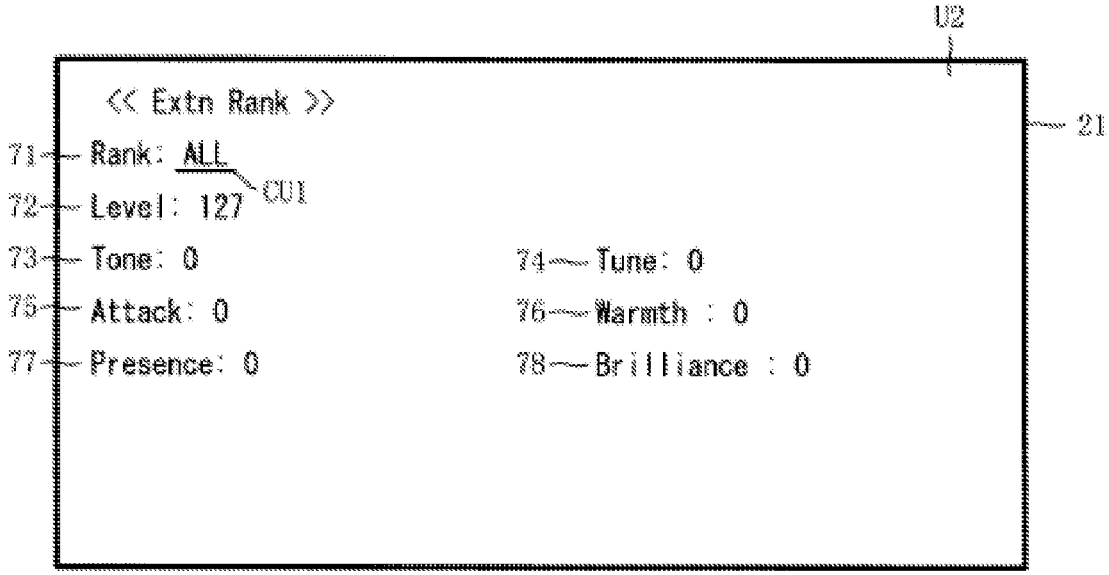

FIG. 7*c* schematically shows a display example of the user interface U2. The user can change data DA14 (see FIG. 4) in the set data 13*a* and 14*a*, using the user interface U2 displayed in the LCD 21.

Items 71-78 and respective set values are displayed in the user interface U2. Item 71 (Rank) displays a value for selecting a subject voice whose set values are to be changed. The set value at Item 71 may be "ALL" or one of values from "1" to "6". When "ALL" is displayed at Item 71, data DA14a-DA14g for all voices (Ranks) for the drawknob number being selected, in the set data 13*a*, can be set at once. On the other hand, when one of the values from "1" to "6" is displayed at Item 71, data DA14a-DA14g for one voice (Rank) corresponding to the value displayed at Item 71, for the drawknob number being selected, in the set data 13*a*, can be set.

Item 72 (Level) displays a value of data DA14a of the voice (Rank) corresponding to the value displayed at Item 71 for the drawknob number being selected. Concretely, when the value displayed at Item 71 is one of values from "1" to "6", the value of data DA14a of the voice (Rank) indicated by the value is displayed. On the other hand, when the value displayed at Item 71 is "ALL", the value of data DA14a of one representative voice (Rank) is displayed. Item 73 (Tone) displays a value of data DA14b of the voice (Rank) corresponding to the value displayed at Item 71 for the drawknob number under selection in the set data 13*a*. Item 74 (Tune) displays a value of data DA14c of the voice (Rank) corresponding to the value displayed at Item 71 for the drawknob number under selection in the set data 13*a*. Item 75 (Attack) displays a value of data DA14d of the voice (Rank) corresponding to the value displayed at Item 71 for the drawknob number under selection in the set data 13*a*.

Item 76 (Warmth) displays a value of data DA14e of the voice (Rank) corresponding to the value displayed at Item 71 for the drawknob number under selection in the set data 13*a*. Item 77 (Presence) displays a value of data DA14f of the voice (Rank) corresponding to the value displayed at Item 71 for the drawknob number under selection in the set data 13*a*. Item 78 (Brilliance) displays a value of data DA14g of the voice (Rank) corresponding to the value displayed at Item 71 for the drawknob number under selection in the set data 13*a*.

The set value of each of Items 71-78 can be designated by placing the cursor CU1 thereon by rotational operation of the manipulator 22*a* and changed by rotational operation of the manipulator 22*b*. When set values are changed, in the set data 13*a*, corresponding data DA14a-DA14g among data DA14 for a combination of the drawknob number under selection and Item 71 (Rank) are changed.

FIGS. 8*a*, 8*b*, 8*c*, 8*d* schematically show display examples of the user interface U3. The user can change data DA15 (see FIG. 5) in the data 13*a* and 14*a*, using the user interface U3 displayed in the LCD 21.

Figure 8A:
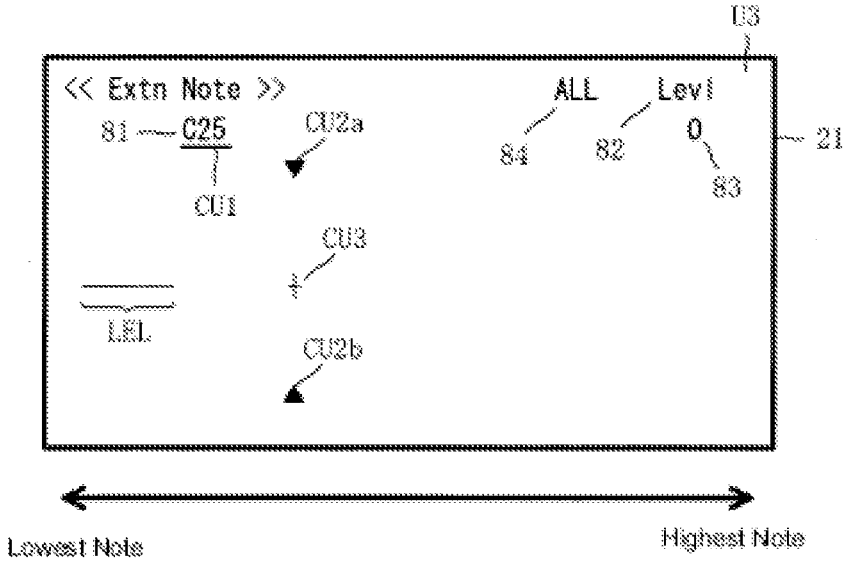
FIGS. 8*a*, 8*b*, 8*c*, and 8*d* are schematic illustrations showing display embodiments of user interfaces.
Figure 8B:
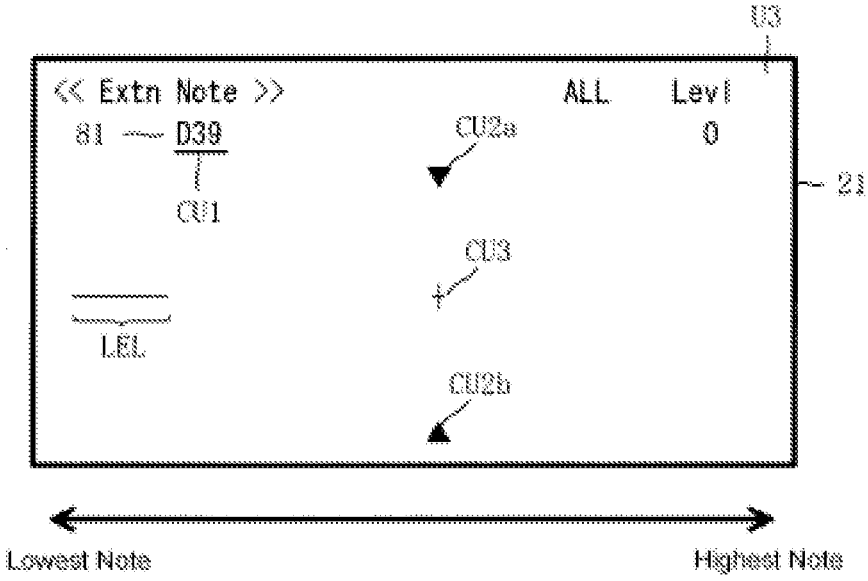
Figure 8C:
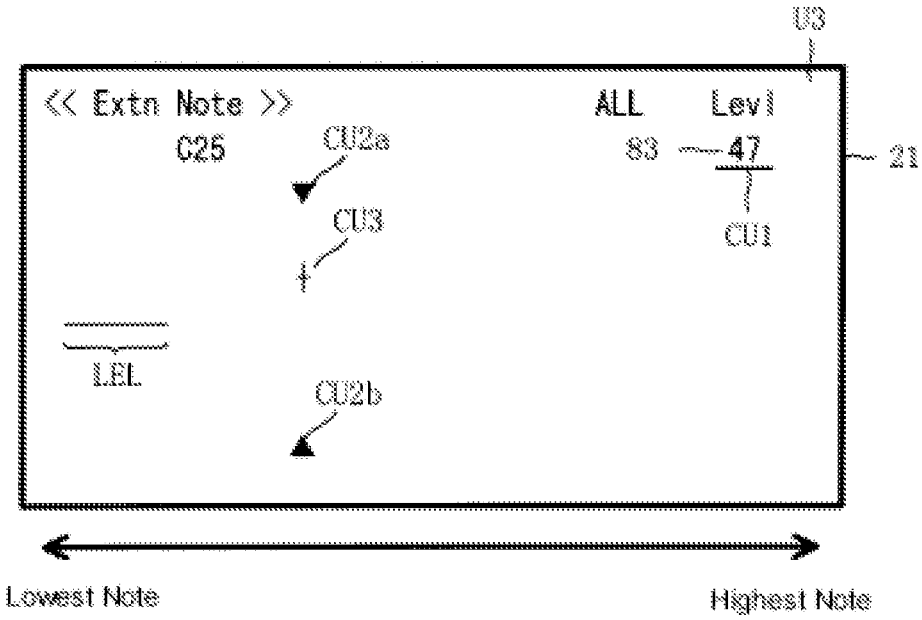
Figure 8D:
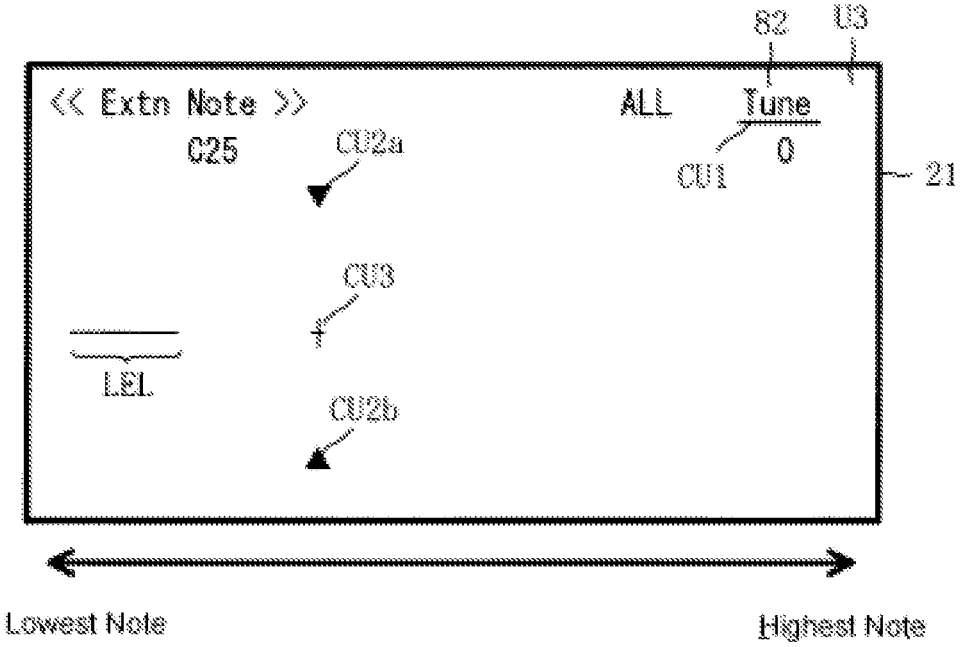

Item 84 shown in FIG. 8*a* is displayed in the upper right of the user interface U3. Item 84 displays, similar to Item 71 in the user interface U2, a value for selecting a subject voice (Rank) whose set values are to be changed. The set value at Item 84 may be "ALL" or one of values from "1" to "6". In the example shown in FIG. 8*a*, "ALL" is displayed at Item 84. The set value at Item 84 can be designated by placing the cursor CU1 thereon by rotational operation of the manipulator 22*a*, and changed by rotational operation of the manipulator 22*b*. When "ALL" is displayed at Item 84, data DA15a-DA15g for all voices (Ranks) for the drawknob number under selection, in the set data 13*a*, can be set at once. On the other hand, when one of the values from "1" to "6" is displayed at Item 84, data DA15a-DA15g for one voice (Rank) corresponding to the value displayed at Item 84, for the drawknob number being selected, in the set data 13*a*, can be set.

In the user interface U3, the horizontal direction of the LCD 21 is set as an axis that shows a key region where the pitch goes up from the left toward the right side. Two cursors CU2a and CU2b are displayed according to the keyboard position of a key selected as the subject to change set values. Therefore, the user would readily visually recognize the key selected as the subject to change set values, based on the relative position of the cursors CU2a and CU2b with respect to the width of the screen.

A set value 81 indicating the keyboard position of the key selected as the subject of changing set values is displayed on the upper left side of the user interface U3. For example, in FIG. 8*a*, "C25" is displayed as the set value 81, indicating that the key corresponding to C25 is selected. After placing the cursor CU1 to the set value 81 by rotational operation of the manipulator 22*a*, the user can change the set value 81 by rotationally operating the manipulator 22*b*. Alternatively, by depressing a desired key in a keyboard (any of the keyboards 23-25) to which the drawknob number under selection belongs, while the user interface U3 is being displayed, the user can change the set value 81 to a value indicating the key depressed.

When the set value 81 is changed, the cursors CU2a and CU2b and the cursor CU3 displayed between the cursor CU2a and CU2b move in the axial direction showing the key region (in the horizontal direction of the LCD 21) along with the change, and it is displayed at a position corresponding to the set value 81. For example, when the set value 81 is changed from "C25" to a higher pitched note "D39", the cursors CU2a and CU2b, and the cursor CU3 move to the right from the position shown in FIG. 8(*a*) to the position shown in FIG. 8(*b*).

When "Lo Extn Limit" and/or "Hi Extn Limit" are set to the drawknob number under selection, the user interface U3 displays the setting range in a manner visually recognizable. In the example shown in FIGS. 8*a*, 8*b*, 8*c*, 8*d*, a line LEL extending within the range corresponding to the setting range of "Lo Extn Limit" in the axial direction indicating the key range is shown. The user can recognize that the key region displayed with the line LEL is the key region that is set as "Lo Extn Limit".

Item 82 that is the change subject is displayed on the upper right side of the user interface U3, and a set value 83 corresponding to Item 82 is displayed under Item 82. By rotatably operating the manipulator 22*b*, while the cursor CU1 is placed to the set value 83, the set value 83 can be changed.

When the set value 83 is changed, the cursor CU3 moves upward or downward depending on the change. More specifically, based on the state where the set value 83 is set to "0" (in other words, the current set value set to the voice (Rank) corresponding to the value displayed at Item 84) as reference, the greater the value, the more upward the cursor CU3 moves, and the smaller the value, the more downward the cursor CU3 moves. For example, when the set value 83 is changed from "0" to "47", the cursor CU3 moves upward from the position shown in FIG. 8*a* to the position shown in FIG. 8*c*. By the position of the cursor CU3, the user can visually recognize a relative difference of the value set as the set value 83 with respect to the case where the set value 83 is "0".

Each of the items corresponding to data DA15a-DA15g (see FIG. 5) in the set data 13*a* can be displayed as Item 82. For example, "Levl" corresponding to data DA15a is displayed at Item 82 in FIG. 8*a*, and "Tune" corresponding to data DA15c is displayed at Item 82 in FIG. 8*d*. By rotatably operating the manipulator 22*b*, while the cursor CU1 is placed to Item 82, the user can change Item 82.

Therefore, according to the user interface U3, data corresponding to Item 82 being displayed, among data DA15a-DA15g in the set data 13*a* for the key selected by the set value 81, can be changed by changing the set value 83.

Figure 9A:
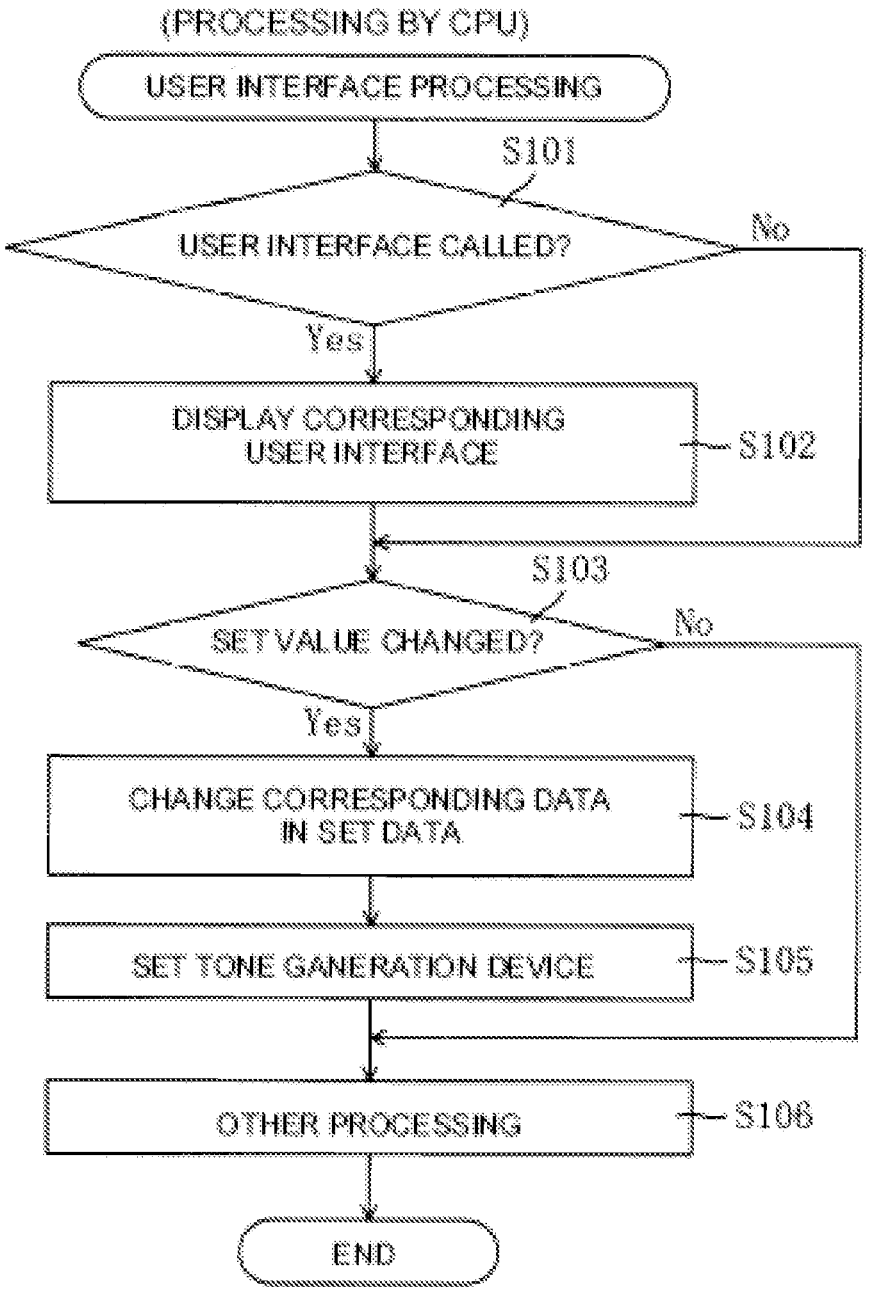
FIG. 9*a* is an embodiment of a flow chart of user interface processing

Next, referring to FIGS. 9*a*, 9*b* and FIGS. 10*a*, 10*b*, the processing executed by the CPU 11 of the electronic organ 1 (the tone control device) having the composition described above in accordance with the embodiment will be described. FIG. 9*a* is a flow chart showing a user interface processing executed by the CPU 11. The processing begins when the electronic organ 1 is powered on, and is executed periodically (for example, every 0.5 seconds) thereafter.

First, the CPU 11 judges whether any of the user interfaces U1-U3 is called by a predetermined operation of the user (S101). When the CPU 11 judges that one of the user interfaces U1-U3 is called (S101: Yes), the CPU 11 has the corresponding user interface displayed in the LCD 21 (S102) and shifts the processing to S103. On the other hand, when the CPU 11 judges in S101 that none of the user interfaces U1-U3 has been called (S101: No), the CPU 11 shifts the processing to S103.

In S103, the CPU 11 judges whether a set value has been changed based on an operation by the user in any of the user interfaces U1-U3 being displayed (S103). When the CPU 11 judges that a set value has been changed (S103: Yes), the CPU 11 changes the corresponding data in set data 13*a* in the RAM 13 (S104).

Next, the CPU 11 sets the tone generation device 16 according to the changed setting (S105), executes other processings (S106), and ends the present processing. In S105, the setting of the tone generation device 16 is executed when the changed set value is a value for setting the timbre, the sound level or the tone quality of the electronic sound, but omits the processing in S105 when the changed set value is a set value other than the above, and the processing is shifted to S106. On the other hand, when the CPU 11 judges in S103 that a set value has not been changed (S103: No), the CPU 11 shifts the processing to S106.

Figure 9B:
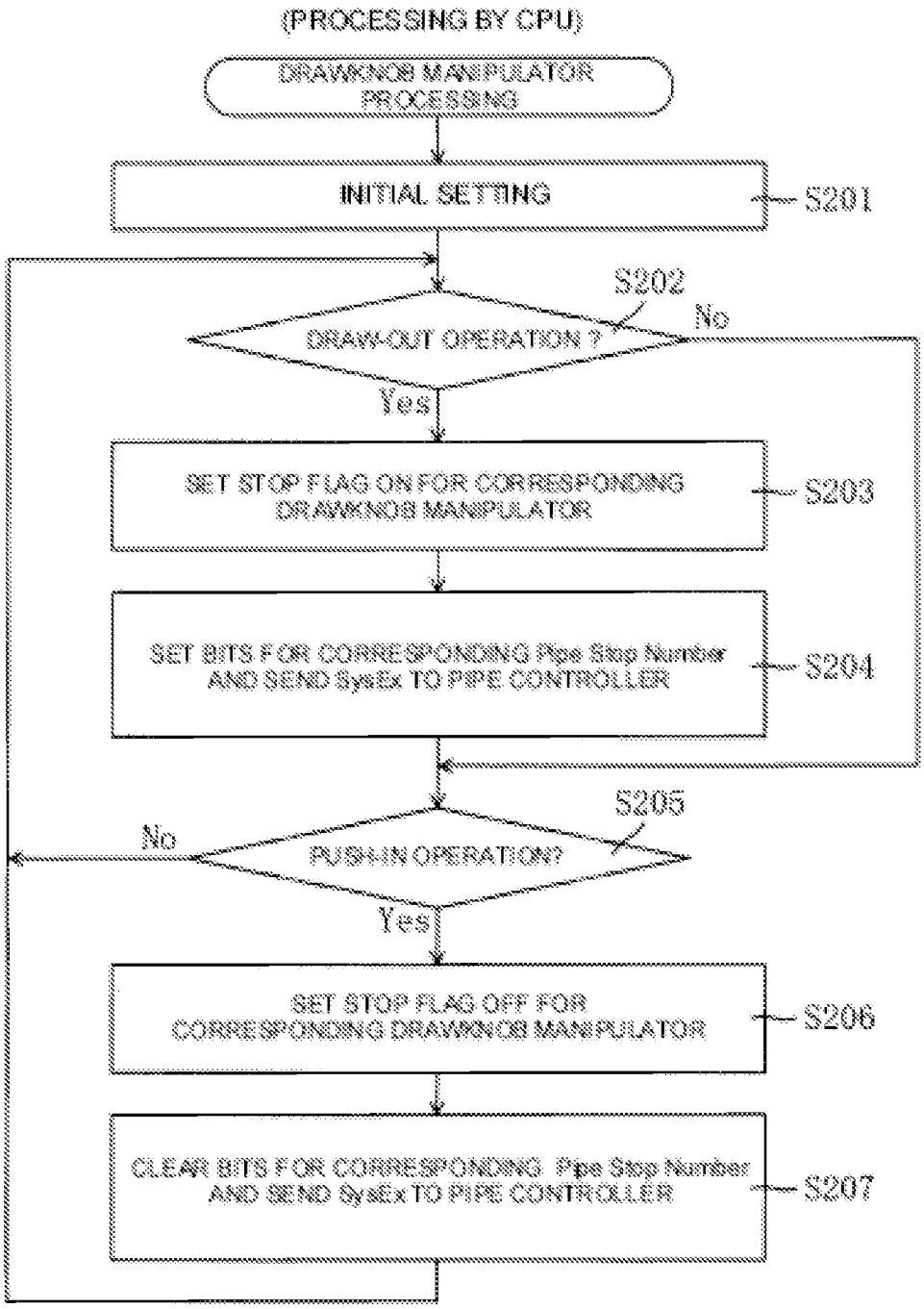
FIG. 9*b* is an embodiment of a flow chart of drawknob manipulator processing.

FIG. 9*b* is a flow chart showing a drawknob manipulator processing that the CPU 11 executes. This processing begins when the power supply to the electronic organ 1 is turned on. First, the CPU 11 clears bits corresponding to all Pipe Stop Numbers as an initial setting, and transmits SysEx (System Exclusive) to the pipe controller 101 (S201). As a result, all ranks R set up in the pipe unit 100 are set as non-tone generation subjects.

Next, the CPU 11 judges whether there is a draw-out operation on a drawknob manipulator 26-28 (S202). When the CPU 11 judges that there is a draw-out operation on a drawknob manipulator 26-28 (S202: Yes), the CPU 11 sets STOP flag (not shown in the figure) to ON for the corresponding drawknob manipulator (S203). The STOP flag is a flag provided in the RAM 13, and one STOP flag is provided for each of the drawknob manipulators, whereby the operation status of the drawknob manipulator is stored. More specifically, all the STOP flags are set OFF when the power supply to the electronic organ 1 is turned on, and when there is a draw-out operation on a drawknob manipulator, the STOP flag corresponding to the drawknob manipulator is set ON. On the other hand, when there is a push-in operation on a drawknob manipulator, the STOP flag corresponding to the drawknob manipulator is set OFF.

Next, the CPU 11 sets up bits corresponding to the corresponding Pipe Stop Number, and transmits SysEx to the pipe controller 101 (S204). As a result, among ranks R set up in the pipe unit 100, a rank R corresponding to the drawknob manipulator drawn out is set as the subject of tone generation.

After the processing in S204, the CPU 11 shifts the processing to S205. Also, when the CPU 11 judges in S202 that there is no draw-out operation on the drawknob manipulator 26-28 (S202: No), the CPU 11 also shifts the processing to S205. In S205, the CPU 11 judges whether there is a push-in operation on the drawknob manipulators 26-28 (S205). When the CPU 11 judges that there is no push-in operation on the drawknob manipulators 26-28 (S205: No), the CPU 11 shifts the processing to S202.

On the other hand, when the CPU 11 judges in S205 that there is a push-in operation on the drawknob manipulators 26-28 (S205: Yes), the STOP flag (not shown in the figure) for the corresponding drawknob manipulator is set OFF (S206). Next, the CPU 11 clears the bits corresponding to the corresponding Pipe Stop Number, and transmits SysEx to the pipe controller 101 (S207). As a result, among the ranks R set up in the pipe unit 100, a rank R corresponding to the drawknob manipulator pushed in is set as the subject of non-tone generation. After the processing in S207, the CPU 11 shifts the processing to S202.

Figure 10A:
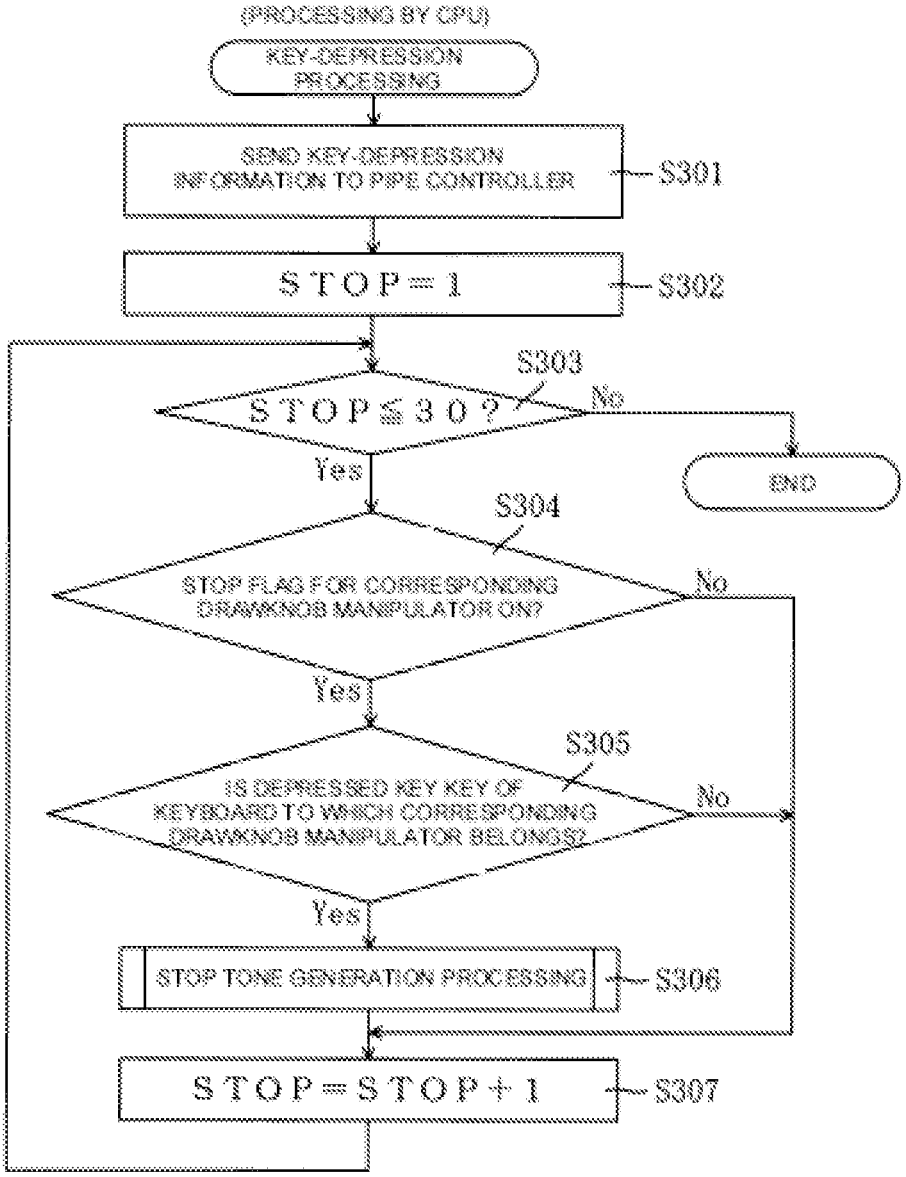
FIG. 10*a* is an embodiment of a flow chart of key depression processing.

FIG. 10*a* is a flow chart showing a key-depression processing that the CPU 11 executes. This processing begins each time a key in the keyboards 23-25 is depressed. First, the CPU 11 transmits key-depression information corresponding to the key depressed to the pipe controller 101 (S301), and sets 1 to Variable STOP (S302). Next, the CPU 11 judges whether the value of Variable STOP is 30 or less (S303). When the CPU 11 judges that the value of Variable STOP is 30 or less (S303: Yes), the CPU 11 judges whether the STOP flag for the corresponding drawknob manipulator (that is, the drawknob manipulator corresponding to the value of Variable STOP) is ON (S304).

In S304, when the CPU 11 judges that the STOP flag to the corresponding drawknob manipulator is ON (S304: Yes), the CPU 11 judges whether the key depressed is in a keyboard 23-25 that belongs to the corresponding drawknob manipulator (S305), the belonging keyboard DA3. The judgment in S305 is performed by referring to the set data 13*a*, and comparing the keyboard 23-25 having the depressed key to the belonging keyboard (data DA3) for the drawknob number of the variable STOP.

In S305, when the CPU 11 judges that the depressed key is a key of the belong keyboard for the corresponding drawknob manipulator of the variable STOP (S305: Yes), the CPU 11 executes a STOP tone generation processing that performs tone generation of electronic sound if necessary (S306). In other words, the STOP tone generation processing (S306) is executed, when a key is depressed in a keyboard belonging to the drawknob manipulator. STOP tone generation processing (S306) is described with respect to FIG. 10*b*.

The CPU 11 adds 1 to the value of Variable STOP after the STOP tone generation processing (S306) has been executed (S307), and shifts the processing to S303. On the other hand, when the CPU 11 judges in S304 that the STOP flag for the corresponding drawknob manipulator is OFF (S304: No), or when the CPU 11 judges in S305 that the key depressed is not a key in the keyboard that belongs to the corresponding drawknob manipulator (S305: No), the CPU 11 adds 1 to the value of Variable STOP (S307), and shifts the processing to S303. Then, when the CPU 11 judges in S303 that the value of Variable STOP exceeds 30 (S303: No), the CPU 11 ends the processing.

Figure 10B:
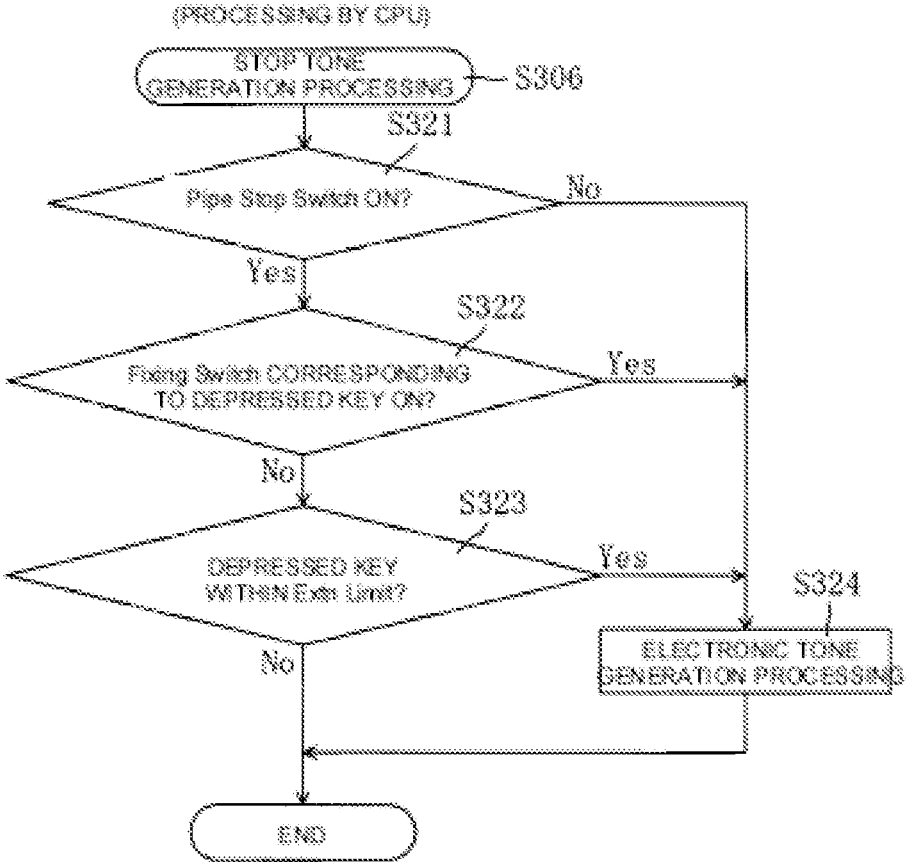
FIG. 10*b* is an embodiment of a flow chart of STOP tone generation processing.

FIG. 10*b* is a flow chart showing the STOP tone generation processing described above. First, the CPU 11 judges whether the value of Pipe Stop Switch for the corresponding drawknob manipulator is "ON" (S321). The judgment in S321 is performed by referring to the set data 13*a*, and made based on the value of Pipe Stop Switch (data DA4) for the drawknob number corresponding to the corresponding drawknob manipulator.

In S321, when the CPU 11 judges that the value of Pipe Stop Switch for the corresponding drawknob manipulator is "OFF" (S321: No), a Rank R in the pipe unit 100 is not set for the corresponding drawknob manipulator. Therefore, in this case, the CPU 11 executes an electronic tone generation processing (S324) and ends the present processing. In the electronic tone generation processing (S324), the CPU 11 outputs a tone generation instruction including information indicative of the corresponding drawknob manipulator and information indicative of the key depressed to the tone generation device 16, thereby making the tone generation device 16 generate electronic sound based on the tone generation instruction.

On the other hand, in S321, when the CPU 11 judges that the value of Pipe Stop Switch for the corresponding drawknob manipulator is "ON" (S321: Yes), the CPU 11 judges whether Fixing Switch corresponding to the depressed key is ON (S322). The judgment in S322 is performed by referring to the set data 13*a*, and made based on the value of "ON" or "OFF" stored the corresponding to the key depressed, among Fixing Note (data DA10) corresponding to the corresponding drawknob manipulator. When this value is "ON", the CPU 11 judges in S322 that Fixing Switch corresponding to the key depressed is ON.

In S322, when the CPU 11 judges that Fixing Switch corresponding to the depressed key is ON (S322: Yes), a real pipe P corresponding to the depressed key is subject to pipe fixing. Therefore, in this case, the CPU 11 executes the electronic tone generation processing (S324), and ends this processing.

On the other hand, when the CPU 11 judges in S322 that Fixing Switch corresponding to the depressed key is OFF (S322: No), the CPU 11 judges whether the depressed key is within the range of Extn Limit (S323). The judgment in S323 is performed by referring to the set data 13*a*, and made based on the set values of Lo Extn Limit (data DA8) and Hi Extn Limit (data DA9). When the depressed key is included within the key region indicated by these set values, the CPU 11 judges in S323 that the depressed key is within the range of Extn Limit.

In S323, when the CPU 11 judges that the depressed key is within the range of Extn Limit (S323: Yes), a real pipe P is not set up for the depressed key. Therefore, in this case, the CPU 11 executes the electronic tone generation processing (S324), and ends the present processing.

On the other hand, when the CPU 11 judges in S323 that the depressed key is outside the range of Extn Limit (S323: No), the CPU 11 ends the present processing. For a depressed key for which the electronic tone generation processing (S324) is not executed by the STOP tone generation processing, among the ranks R in the pipe unit 100, a real pipe P corresponding to the depressed key in a rank R that is the subject of tone generation is made to generate tone.

According to the electronic organ 1 (the tone generation control device) of the embodiment described above, when a key on the keyboards 23-25 is depressed, and when the depressed key is a key whose data DA10 in the set data 13*a* is stored as "ON", and when the real pipe P corresponding to the depressed key belongs to a rank R specified as the subject of tone generation, electronic sound that replaces the real pipe P is generated from the tone generation device 16. Therefore, when trouble, such as, breakdown, etc. occurs in a real pipe P set up in the pipe unit 100, the real pipe P with the trouble may be set to data DA10 as the subject of pipe fixing, whereby substitute electronic sound (substituting tone) for the real pipe P with the trouble can be generated in the unit of each of the real pipes P that compose the rank R. Moreover, in this case, the subject of pipe fixing can be designated with the key. A trouble in a real pipe P is normally perceived as uncomfortable feeling when the user depresses a corresponding key. Therefore a real pipe P with a trouble can be readily, promptly designated by the corresponding key.

While the substituting tone corresponding to the real pipe P with the trouble can be generated, other real pipes P which belong to the same rank R (the row of pipes) as the real pipe P with the trouble can be used as is, such that loss of the characteristic sound of the tone to be generated from the real pipes P would be suppressed. Accordingly, in accordance with the electronic organ 1 having a tone generation control device in accordance with the embodiment, even when a trouble occurs in a real pipe P set up, performance as intended by the user can be restarted at an early stage.

Also, for each rank R, a characteristic parameter of electronic sound (substituting tone) can be set for each of the real pipes P composing the rank R. Therefore, even when tone is generated by other real pipes P that belong to the same rank R as the real pipe P concerned, while generating the electronic sound for the real pipe P with the trouble, the electronic sound for the real pipe P with the trouble can be adjusted so as not to cause an uncomfortable feeling. Therefore, performance that compares favorably with the case of generating tone with all the real pipes P can be realized.

In the embodiment described above, the processing S104 is exemplified as a pipe designation device, a changing device, and a setting device. The processing S322 is exemplified as a control device.

The invention is described above with respect to different embodiments, but the invention is not at all limited by the embodiments described above, and it is readily presumed that various modifications and improvements can be made within the range that does not depart from the subject matter of the invention.

For example, in the above-described embodiment, a structure in which the tone control device is built into the electronic organ 1 is provided. However, a composition that corresponds to the tone control device (the CPU, the ROM, the RAM, the flash memory, the tone generation device, the operation panel, the LCD, and the setting manipulators) may be built into the pipe controller 101, and the composition may be connected with the electronic organ 1. In this case, the processing in the flow charts shown in FIG. 9*a*, FIG. 10*a* and FIG. 10*b* may be executed by the CPU of the tone control device of the pipe controller 101. Moreover, a composition that corresponds to the tone control device may be mounted on the pipe organ.

Moreover, in the above-described embodiment, the tone control device is described assuming that it is composed of the CPU 11, the ROM 12, the RAM 13, the flash memory 14, the tone generation device 16, the operation panel 15, the LCD 21 and the setting manipulators 22. However, it may be composed of the components except the tone generation device 16.

Moreover, in the above-described embodiment, the keyboard position of a key is specified at Item 57 (Fixing Note#), and whether a real pipe P corresponding to the position of the key displayed at Item 57 is the subject of pipe fixing is set at Item 58 (Fixing Switch). However, it may be composed such that, when a key is depressed, in the state in which the rank R corresponding to STOP name displayed at Item 51 (Target) is designated as the subject of tone generation, the corresponding real pipe P may be set as the subject of pipe fixing.

Moreover, in the above-described embodiment, in S322 of the STOP tone generation processing (see FIG. 10), when the value of Fixing Note (data DA10) of the depressed key corresponding to the drawknob manipulator to be processed is "ON", the CPU 11 is composed to judge that Fixing Switch corresponding to the depressed key that is ON. However, in S322, the condition for which the CPU 11 judges that Fixing Switch corresponding to the depressed key is ON is not limited to the value of Fixing Note (data DA10). For example, information (for example, "OFF") indicating that electronic sound is not to be used as data DA15a (Level) of each key corresponding to a drawknob manipulator to be processed may be made settable. In S322, when the value of data DA15a (Level) of a depressed key corresponding to a drawknob manipulator to be processed is information indicating not to use electronic sound, the CPU 11 may judge that Fixing Switch corresponding to the depressed key is ON. Alternatively, it may be composed such that the sound level can be set to each key, in place of Fixing Note (data DA10), and in S322, when the sound level for a depressed key corresponding to a drawknob manipulator to be processed is "0", the CPU 11 may judge that Fixing Switch corresponding to the depressed key is ON. Therefore, the "information indicative of whether or not a substituting tone is to be generated" in the patent claim is not limited to Fixing Note (data DA10), but may also correspond to each of the parameters exemplified above.

Moreover, in accordance with the embodiment described above, based on a value of one data DA5 (Pipe Stop Number) set to each drawknob manipulator, the pipe controller 101 is composed to set one or plural ranks R, that are decided beforehand for the value of data DA5, to a tone generation subject. In place of this composition, for each drawknob manipulator, values corresponding to data DA5 may be prepared for a plurality of (six, for example) ranks R, and it may be composed such that an arbitrary one of the ranks R may be designated by a user interface (the user interface U1, for example) of the electronic organ 1. When the drawknob manipulator is drawn out, the pipe controller 101 may set ranks R in the number specified for the drawknob manipulator as the subject of tone generation. By such a composition, mixture stops can be freely formed as desired by the user on the side of the electronic organ 1.

Moreover, in the above-described embodiment, the electronic organ 1 is composed in a manner that, when a drawknob manipulator is operated, set bits of the corresponding Pipe Stop Number are set, and a System Exclusive (SysEx) is transmitted to the pipe controller 101. In other words, in the above-described embodiment, the electronic organ 1 transmits, via the pipe I/F 17 to the pipe controller 101, information as to whether or not a rank R as a unit is to be made the subject of tone generation, according to the operation of a drawknob manipulator. Instead, it may be composed in a manner that, when a drawknob manipulator is operated, the electronic organ 1 transmits, via the pipe I/F 17 to the pipe controller 101, to each of the real pipes P that compose a rank R corresponding to the operated drawknob manipulator, information as to whether or not the real pipe P is to be made the subject of tone generation, respectively. For example, when a drawknob manipulator is operated and drawn out, information not to make a tone generation subject may be transmitted to the pipe controller 101, for a real pipe P that is set as the subject of pipe fixing by data DA10 (Fixing Note) among real pipes P that compose a rank R corresponding to the drawknob manipulator, and information to make a tone generation subject may be transmitted to the pipe controller 101 for the remaining real pipes P. Adopting such a composition is advantageous in that the degree of freedom in controlling each of the real pipes P will increase, though the volume of information transmitted from the pipe I/F 17 to the pipe controller 101 increases.

Alternatively, it may be composed such that, to each real pipe P capable of tone generation in response to a depressed key, which is specified based on the setting of data DA3 (Belonging Keyboard), the state of operation (the setting of STOP flag) of the drawknob manipulators 26-28, and information as to whether to make each real pipe P a tone generation subject, which is decided according to the setting of data DA10 (Fixing Note), may be transmitted from the pipe I/F 17 to the pipe controller 101.

Moreover, if a relatively fast communication route can be secured, without sending event-driven information that may be generated upon key-depression, operation of a drawknob manipulator, and the like, information as to whether or not to make a pertinent real pipe P the subject of tone generation may be transmitted to all the real pipes at a constant interval (for example, once each 5 ms) from the pipe I/F 17 to the pipe controller 101. Adopting such a composition is advantageous in that, even when noise enters the communication route, the settings can be recovered each time when transmitting information as to whether or not to make the real pipe P the subject of tone generation.

Moreover, in the above-described embodiment, the communication between the pipe I/F 17 and the pipe unit 100 is assumed to use current-loop serial data signals. However, as the mode of data communications, various data communication modes, such as, highly noise-resistant communications using optical fibers, Ethernet (registered trademark), wireless LAN, and the like may be used, without any particular limitation to current-loop serial data signals.

What is claimed is:

1. A tone control device coupled to a musical instrument including a plurality of pipes capable of generating tones with differing pitches for keys, wherein the pipes are arranged in rows, comprising:

a tone generation device that generates tone;

a pipe designation device that designates a specified pipe among the pipes installed; and a control device that causes the tone generation device to generate a substituting tone corresponding to the specified pipe when a depressed key comprising one of the keys corresponds to the specified pipe designated by the pipe designation device, and the specified pipe belongs to one of the rows of pipes designated as a tone generation subject.

2. The tone control device of claim 1, wherein the pipe designation device designates the specified pipe by designating the row of pipes to which the specified pipe belongs and one of the keys corresponding to the specified pipe.

3. The tone control device of claim 2, wherein the pipe designation device designates the specified pipe by depressing the key corresponding to the specified pipe in a state where the row of pipes to which the specified pipe belongs is designated as the tone generation subject.

4. The tone control device of claim 1, further comprising:

a setting memory device that stores in a memory, for each of the rows of pipes, associated with each key, information indicative of whether the substituting tone corresponding to the pipe that corresponds to the key is to be generated, wherein the control device causes the tone generation device to generate the corresponding substituting tone when the setting memory device stores information indicating to generate the substituting tone for the depressed key in one of the rows of pipes designated as the tone generation subject.

5. The tone control device of claim 4, further comprising:

a changing device that changes, when the pipe designation device designates the specified pipe by designating the row of pipes to which the specified pipe belongs and the key corresponding to the specified pipe, information corresponding to the designated key in the designated row of pipes in the setting memory device to information indicating to generate the substituting tone.

6. The tone control device of claim 1, further comprising:

a setting device that sets a characteristic parameter of the substituting tone corresponding to the specified pipe to be generated by the tone generation device.

7. The tone control device of claim 6, wherein the characteristic parameter of the substituting tone to be set by the setting device is at least one of sound level, timbre and pitch parameters.

8. A computer storage device including program code executed by a processor for generating a tone and in communication with a tone generation device, a pipe controller controlling a plurality of pipes for producing sound, a plurality of keyboards each having keys, and manipulators for selecting ranks of pipes to generate sound, wherein the code is executed to perform operations, the operations comprising:

providing a data structure in the computer storage device indicating for each of the manipulators:

a belonging keyboard indicating one of the keyboards;

one of the ranks of pipes to play for the manipulator;

a pipe stop switch set to ON or OFF in response to selection of the manipulator; and fixing switches indicating whether keys on the belonging keyboard selected are available or unavailable; and causing the pipes in a selected rank of the ranks to generate a tone for a depressed key in response to determining that the data structure indicates for one of the manipulators the selected rank, the belonging keyboard as the keyboard including the depressed key, that the pipe stop switch as ON, and that the fixing switch for the depressed key indicates that the key is available.

9. The computer storage device of claim 8, wherein the operations further comprise:

causing the tone generation device to play a tone for the depressed key in response to determining that according to the data structure no manipulator indicates that there is a rank of pipes available to play for the depressed key.

10. The computer storage device of claim 8, wherein no manipulator is determined to indicate there is a rank of pipes available to play for the depressed key in response to determining that all the manipulators have at least one of the pipe stop switch OFF and the fixing switch for the depressed key set to unavailable.

11. The computer storage device of claim 8, where a number of fixing switches indicated for each manipulator comprises a number of keys on the keyboard having a most keys, and wherein the fixing switches for keys not included on the belonging keyboard are indicated as unavailable.

12. The computer storage device of claim 8, wherein the data structure indicates for each rank of pipes characteristics of a tone to play for the pipes in the rank including at least one of tone, tune, attack, warmth presence, and brilliance, wherein the tone generation device plays the tone for the depressed key according to the characteristics of the tone indicated in the data structure for the rank indicated for the manipulator having the pipe switch set to ON and the fixing switch for the depressed key set to available.

13. The computer storage device of claim 8, wherein the data structure indicates for each manipulator characteristics of the tone when the tone generation device generates the tone for the depressed key.

14. The computer storage device of claim 8, wherein the data structure indicates for each manipulator whether to use the tone generation device for a specified register of a sound region, wherein the tone generation device is used to generate the tone when the data structure indicates for the manipulator that the pipe switch is ON, the fixing switch for the depressed key is set to available and the depressed key is for the tone in the specified register of the sound region.

15. A computer storage device including a data structure processed by program code executed by a processor for generating a tone from one of a tone generation device and a plurality of pipes, wherein the tone may be selected from one of a plurality of keyboards each having keys, and wherein manipulators are used for selecting ranks of pipes to generate sound, comprising:

entries in the data structure indicating for the manipulators;

a belonging keyboard indicating one of the keyboards;

one of the ranks of pipes to play for the manipulator;

a pipe stop switch set to ON or OFF in response to selection of the manipulator; and fixing switches indicating whether keys on the belonging keyboard selected are available or unavailable;

wherein the entries in the data structure are processed to select one of the ranks of pipes and the tone generation device to produce sound for a depressed key on one of the keyboards.

16. A method, comprising:

designating a specified pipe among a plurality of pipes capable of generating tones with differing pitches for keys of a musical instrument, wherein the pipes are arranged in rows; and generating a substituting tone corresponding to a specified pipe of a plurality of pipes capable of generating tones when a depressed key comprising one of the keys corresponds to the designated specified pipe, and the specified pipe belongs to one of the rows of pipes designated as a tone generation subject.

17. The method of claim 16, wherein the specified pipe is designated by designating the row of pipes to which the specified pipe belongs and one of the keys corresponding to the specified pipe.

18. The method of claim 17, wherein the specified pipe is designated by receiving indication of the depressing of the key corresponding to the specified pipe in a state where the row of pipes to which the specified pipe belongs is designated as the tone generation subject.

19. The method of claim 16, further comprising:

storing in a setting memory device for each of the rows of pipes, associated with each key, information indicative of whether the substituting tone corresponding to the pipe that corresponds to the key is to be generated, wherein the substituting tone is generated when the setting memory device stores information indicating to generate the substituting tone for the depressed key in one of the rows of pipes designated as the tone generation subject.

20. The method of claim 19, further comprising:

changing, when the pipe designation device designates the specified pipe by designating the row of pipes to which the specified pipe belongs and the key corresponding to the specified pipe, information corresponding to the designated key in the designated row of pipes in the memory device to information indicating to generate the substituting tone.

21. The method of claim 16, further comprising:

setting a characteristic parameter of the substituting tone corresponding to the specified pipe to be generated by the tone generation device.

* * * * *